US012611563B2

(12) United States Patent
Mehrgan et al.

(10) Patent No.: US 12,611,563 B2
(45) Date of Patent: Apr. 28, 2026

(54) PORTABLE MODULAR WORKOUT MACE SYSTEM

(71) Applicants: Behrang Mehrgan, West Vancouver (CA); Amir Mosaddeghifar, Maryland, MD (US)

(72) Inventors: Behrang Mehrgan, West Vancouver (CA); Amir Mosaddeghifar, Maryland, MD (US)

( * ) Notice: Subject to any disclaimer, the term of this patent is extended or adjusted under 35 U.S.C. 154(b) by 139 days.

(21) Appl. No.: 17/208,150

(22) Filed: Mar. 22, 2021

(65) Prior Publication Data

US 2022/0184443 A1 Jun. 16, 2022

Related U.S. Application Data

(60) Provisional application No. 62/992,996, filed on Mar. 22, 2020.

(51) Int. Cl.
*A63B 15/00* (2006.01)
*A63B 21/075* (2006.01)

(52) U.S. Cl.
CPC ..... *A63B 15/00* (2013.01); *A63B 21/075* (2013.01)

(58) Field of Classification Search
CPC ..... A63B 21/0724; A63B 21/0726; A63B 21/0722; A63B 71/0036; A63B 2071/0683; A63B 2210/50; A63B 2220/17; A63B 2220/40; A63B 2225/20; A63B 2225/50; A63B 2225/74; A63B 21/00196; A63B 15/00–02; A63B 21/0004; A63B 21/00058–00065; A63B 21/02; A63B 21/05–0557; A63B 21/06; A63B 21/0604; A63B 21/062; A63B 21/0626–0632; A63B 21/072–075; A63B 21/4033; A63B 21/4035; Y10T 403/7015
See application file for complete search history.

(56) References Cited

U.S. PATENT DOCUMENTS

| | | | | | |
|---|---|---|---|---|---|
| 3,743,297 | A * | 7/1973 | Dennis | A63B 15/00 | 482/109 |
| 4,722,523 | A * | 2/1988 | Yang | A63B 17/04 | 482/40 |
| 6,196,921 | B1 * | 3/2001 | Larson | F41B 15/02 | 463/47.5 |
| 7,731,640 | B1 * | 6/2010 | Chen | A63B 21/0728 | 482/93 |
| 7,731,641 | B1 * | 6/2010 | Chen | A63B 21/075 | 482/106 |
| 10,603,537 | B2 * | 3/2020 | Collier | A63B 21/4017 | |
| 2004/0009826 | A1 * | 1/2004 | Aisenberg | A63B 69/3632 | 473/256 |
| 2010/0029447 | A1 * | 2/2010 | Song | A63B 21/06 | 482/93 |
| 2012/0220396 | A1 * | 8/2012 | Petersen | A63B 15/00 | 473/457 |

(Continued)

*Primary Examiner* — Megan Anderson
*Assistant Examiner* — Catrina A Letterman

(57) ABSTRACT

A portable modular solution for a workout mace, including a multi section handle, and a mace head capable of having variable weights, where the solution allows adding many different handles, ad-ons and accessories such as different handles for an all-round workout with a single device. The carrying bag/backpack of the modular system may be made in the form of a vest and be doubled as a weight vest.

14 Claims, 40 Drawing Sheets

(56) References Cited

U.S. PATENT DOCUMENTS

| | | | | |
|---|---|---|---|---|
| 2015/0045192 | A1* | 2/2015 | Weck | A63B 15/00 482/109 |
| 2017/0072249 | A1* | 3/2017 | Duffin | A61H 1/0292 |
| 2017/0095689 | A1* | 4/2017 | Weck | A61H 23/06 |
| 2017/0252627 | A1* | 9/2017 | Rosberger | A63B 69/02 |
| 2017/0282003 | A1* | 10/2017 | Giafardino | A63B 15/00 |
| 2019/0277329 | A1* | 9/2019 | Boyer | F16B 33/008 |
| 2021/0154551 | A1* | 5/2021 | Christiansen | A63B 15/00 |
| 2022/0387843 | A1* | 12/2022 | Pasternak | A63B 21/4035 |

* cited by examiner

PORTABLE MODULAR WORKOUT MACE SYSTEM

References Cited:

| | | |
|---|---|---|
| U.S. Pat. No. 259,752 | Jun. 20, 1882 | G. P Fisher Jr. |
| U.S. Pat. No. 295,429 | Mar. 18, 1884 | R Reach, |
| U.S. Pat. No. 275,627 | Apr. 10, 1883 | C. W. |
| U.S. Pat. No. 596,543 | Jan. 4, 1898 | C. L. Randall |
| U.S. Pat. No. 937,225 | Oct. 19, 1909 | W. H. BURR |
| U.S. Pat. No. 9,526,671 | Dec. 27, 2016 | David S. Weck |
| US20170095689A1 | Apr. 6, 2017 | David S. Weck |
| US20170095687A1 | Apr. 6th, 2017 | Scott B. Sonnon |
| U.S. Pat. No. 10,166,428 | Jan. 1, 2019 | Donald Giafardino |
| U.S. Pat. No. 675,314 | May 28, 1901 | F. B. Abenheim |
| U.S. Pat. No. 8,951,172 | Feb. 10, 2017 | Aubrey Marcus |
| U.S. Pat. No. 9,586,073 | Mar. 7, 2017 | Joseph Walker |

BACKGROUND OF THE INVENTION

1. Field of Invention

The present invention provides solutions for a portable modular workout mace.

2. Description of the Related Art

A workout mace can be described as a single weight connected to one end of a handle. The eccentric nature of the mace allows unique possibilities for training muscles.

One of the problems with workout maces is lack of customizability. Maces are normally a unibody device. While its common to have variable weights on barbells, dumbbells and even kettlebells, It is not easy to have variable weights on a device like a mace which is rotated in all angles because doing so, always provides the risk of dropping the weights. It is possible to use a collar clamp to hold weights in place, but a malfunctioning clamp may drop the weights and cause disaster by injuring the user.

lack of customizability means if a user has the intention to have a full set of weights he or she may need to buy 7, 10, 15, 20, 25, 30, and 35 lb maces. It means 7 pcs of workout maces with overall weight of 142 lb. It not only requires a lot of space for storing them, but makes the overall set of maces an expensive package considering all the cost of the material used for the set. Also portability is a big issue for example if the user has the intention to bring the set of maces for an outdoor workout in the nature or during a trip. As later will be shown in this document, it is possible to have a workout mace with variable weights from 7 lb all the way to 35 lb with 1.25 lb or 2.5 lb steps, while overall package weighing only 35 lb.

U.S. Pat. No. 259,752 dated Jun. 20, 1882 G. P Fisher Jr. discloses an adjustable club having a lower fixed part, middle weights, and upper sliding part, being fixed by a spring latch. U.S. Pat. No. 295,429 dated March 18 by R Reach, 1884 and U.S. Pat. No. 275,627 dated Apr. 10, 1883 by C. W. Foster disclose club with removable weights. U.S. Pat. No. 596,543 dated Jan. 4, 1898 by C. L. Randall discloses an Indian club with variable weights. U.S. Pat. No. 937,225 dated Oct. 19, 1909 by W. H. BURR discloses club having a casing and plurality of threaded stackable weights. U.S. Pat. No. 9,526,671 dated Dec. 27, 2016 and Patent No. US20170095689A1 dated Apr. 6, 2017 by David S. Weck disclose a workout club having a fillable head which can provide variable weight by filling the head of the device.

Patent No. US20170095687A1 dated Apr. 6, 2017 by Scott B. Sonnon, provides a convertible weight training system which can basically be used as a workout mace with variable weight. While embodiment A of the present invention seems very similar to this previous art, it is distinguishable by having different thread lock solution for the handles which is based on elastic thread lock solution, which can also be used for the weights. In contrary, the previous art relies on a spring and socket thread lock solution for the handles which is technically impossible for a workout mace. The reason is that a mace needs to have 90~95% of its weight on the mace head, and an extremely light handle which normally needs to be made of a thin wall pipe. Fitting a spring and socket thread lock solution inside thin walls is impossible. Thus, it requires a pipe with very thick walls which results in an unpractical product with a very heavy handle. Also the handle of claim 9 of the previous art requires both longitudinal and rotational forces for disengagement, while the present invention only needs rotational force. Using a standard spring plunger is also suggested for the weights of embodiment A of the present invention, which unlike the previous art, it does not require any sockets on the matching surface and relies on surface friction or may be accompanied by a dented matching surface which can create enough friction to avoid weight loosening.

U.S. Pat. No. 10,166,428 dated Jan. 1, 2019 by Donald Giafardino discloses an adjustable club solution with variable weights and a central bolt. While it's a clever solution, its not practical since changing the weights requires removing the central bolt which disengages all the weights even if a small weight is required to be added. Old U.S. Pat. No. 675,314 dated May 28, 1901 by F. B. Abenheim uses the same approach.

U.S. Pat. No. 8,951,172 dated Feb. 10, 2017 by Aubrey Marcus discloses club having a container and removable weights. U.S. Pat. No. 9,586,073 date Mar. 7, 2017 by Joseph Walker provides an exercise hammer with removable weights. Hammer application is very different from mace workouts. The centrifugal force always pushes the weight toward hammer head while in mace workout, in many cases a mace is kept vertically with the head kept upward, meaning the weights need a very secured grip because if the grip fails and drops the weight, there may be serious injury for the user. The only secured connection suggested by said patent is using threaded collar. While it is highly secured it is not a quick coupling. Such device needs about 6-8 inch of threads in order to fit all the required weights for a heavy workout. Thus, someone using only 1 weight needs to unscrew 6 inches of threads in order to add or remove just one weight. On the contrary, the presented invention is focused both on quick coupling and uncompromised security. Furthermore, there is no solution suggested to prevent the threaded collar from loosening. Thus it will be a rattled and noisy workout experience since only after a few moves, the collar loosens and the weights start to rattle. Same patent also provides a solution with a bar (444) with holes (459). It is based on using standard retention rings. Standard gym retention rings can easily fall off during workout when moved in various directions. They also cannot push the weights together and provide a rattling and noisy experience. Said also requires the second bar used for collars to be thicker than the handle, while the present invention allows same diameter for the whole length of the handle.

BRIEF SUMMARY OF THE INVENTION

The present invention discloses solutions for a portable modular workout mace system and variable weight modular mace heads having quick coupling and secured solutions.

The proposed solution is using a mace head having a modular variable weights system, and a multi section handle consisting of 3-4 sections to allow adjustable length for the handle and also proper package-ability and easy mobility. Various mace head designs are suggested.

A first embodiment is suggested wherein the weights can be stacked on top of each other by means of standard mechanical connections. The preferred solution is using threaded connection between the weights.

In addition to one or more of the features described above or below, or as an alternative, further embodiments may include a modular mace head, including a main centering rod for weights, and a fixed and a movable jaw to keep the weights immobile during workout. Such mace head may include guiding pins to prevent rotation of the weights.

In addition to one or more of the features described above or below, or as an alternative, further embodiments may include a modular mace head, including a fixed weight at the end of the handle, and additional weights being added on the fixed weight from handle side, having a security grip to fix the weights during workout.

In addition to one or more of the features described above or below, or as an alternative, further embodiments may include elastic thread lock solution to prevent components from loosening.

In addition to one or more of the features described above or below, or as an alternative, further embodiments may include a spring plunger thread lock solution to prevent components from loosening.

In addition to one or more of the features described above or below, or as an alternative, further embodiments may include a vibrator module which can be added to the mace head. The vibrator control system may be able to be paired with a smartphone to provide various vibration patterns, and even adjust the vibration pattern and direction according to the type of the workout and position of the mace.

In addition to one or more of the features described above or below, or as an alternative, further embodiments may include an ad-on module which added to the mace such as a light module or a sensor.

In addition to one or more of the features described above or below, or as an alternative, further embodiments may include a hook module which can be added either to the handle or to the head of the mace.

In addition to one or more of the features described above or below, or as an alternative, further embodiments may include different accessories such as but not limited to curl handles, Lat bars, revolving lat bars, cable bars, single rope attachments, stirrup handles, multi exercise bars, Row handles, V-bars, D-handles, D-handle straps, Head Harness, triceps extension rope, kettelbell handle, EZ-bar handle, Indian Club handle, etc.

In addition to one or more of the features described above or below, or as an alternative, further embodiments may include guard ad-ons for at least 1 type of mace head.

In addition to one or more of the features described above or below, or as an alternative, further embodiments may include one of a carrying case which may have a toolbox style design, a carrying bag, a carrying backpack, or a carrying vest doubling as a weight vest.

In addition to one or more of the features described above or below, or as an alternative, further embodiments may include a stand which may keep the mace assembly upright when not in use.

DETAILED DESCRIPTION OF THE INVENTION

A detailed description of the embodiments of the disclosed invention and methods is presented herein by way of exemplification and not limitation with reference to the Figures.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiments may include only some of the described exemplary aspects. Accordingly, the disclosure is not to be seen as limited by the foregoing description, but is only limited by the scope of the appended claims in the non-provisional application.

The terminology used herein is for the purpose of describing particular embodiments only. It is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements and/or components, but do not preclude the presence or addition of one or more other features, integers, steps, operations, element components and/or groups thereof.

The present invention provides a portable modular solution for a workout mace, including a multi section handle, and a mace head capable of having variable weights, where the solution allows adding many different handles, ad-ons and accessories for an all-round workout with a single device. The carrying bag/backpack of the modular system may be replaced by a carrying vest, which may be used as a weight vest. A weight vest is a type of workout vest, which has special pockets to carry weights.

Figure 1:
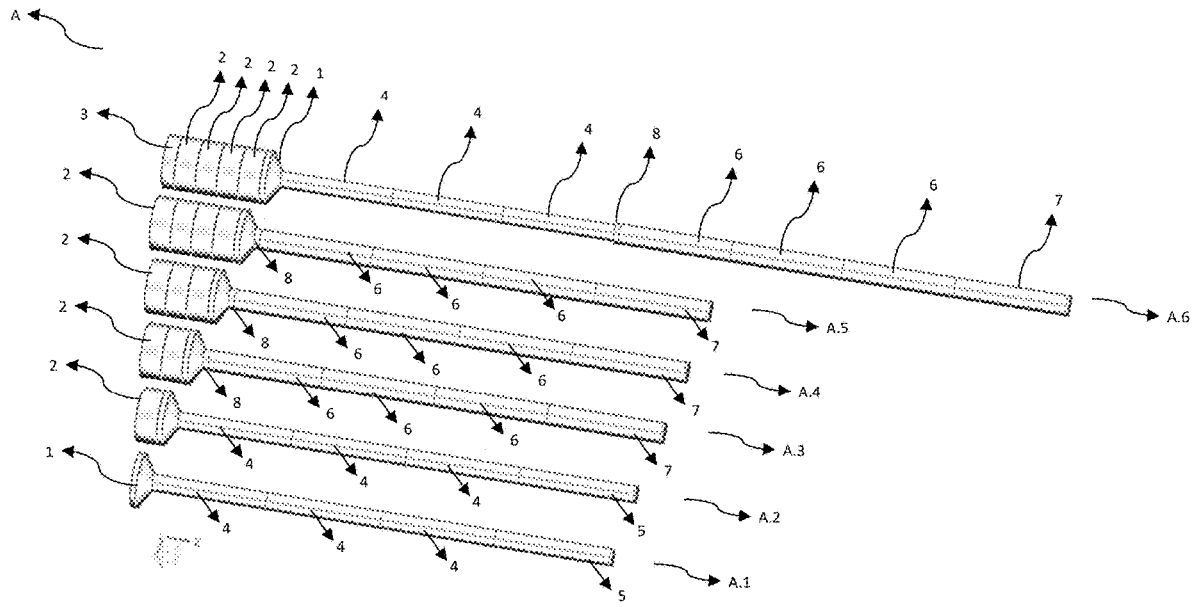
FIG. 1, Displays 6 different configurations for embodiment A of the present invention labeled as A.1 to A.6.
Figure 2:
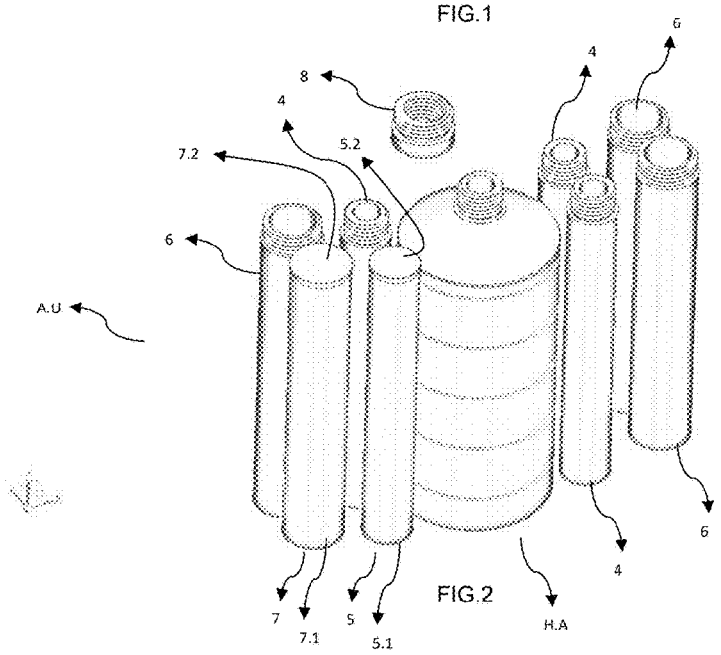
FIG. 2, Displays embodiment A of the present invention in an unassembled configuration labeled as A.U.
Figure 3:
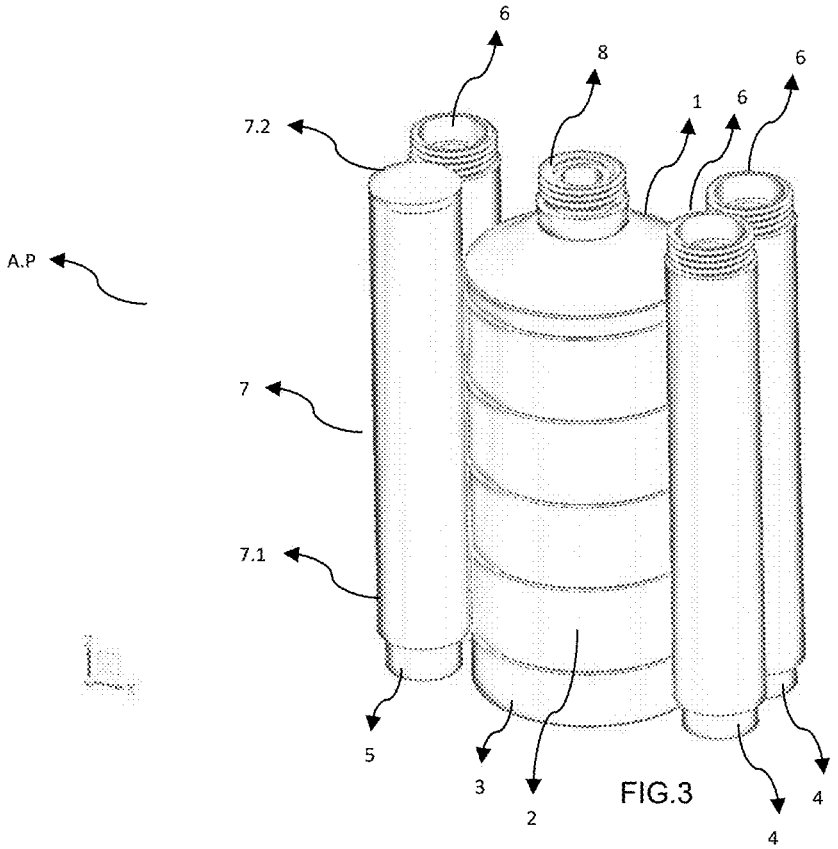
FIG. 3, Displays a perspective view of embodiment A of the present invention in packaging configuration labeled as A.P.
Figure 4:
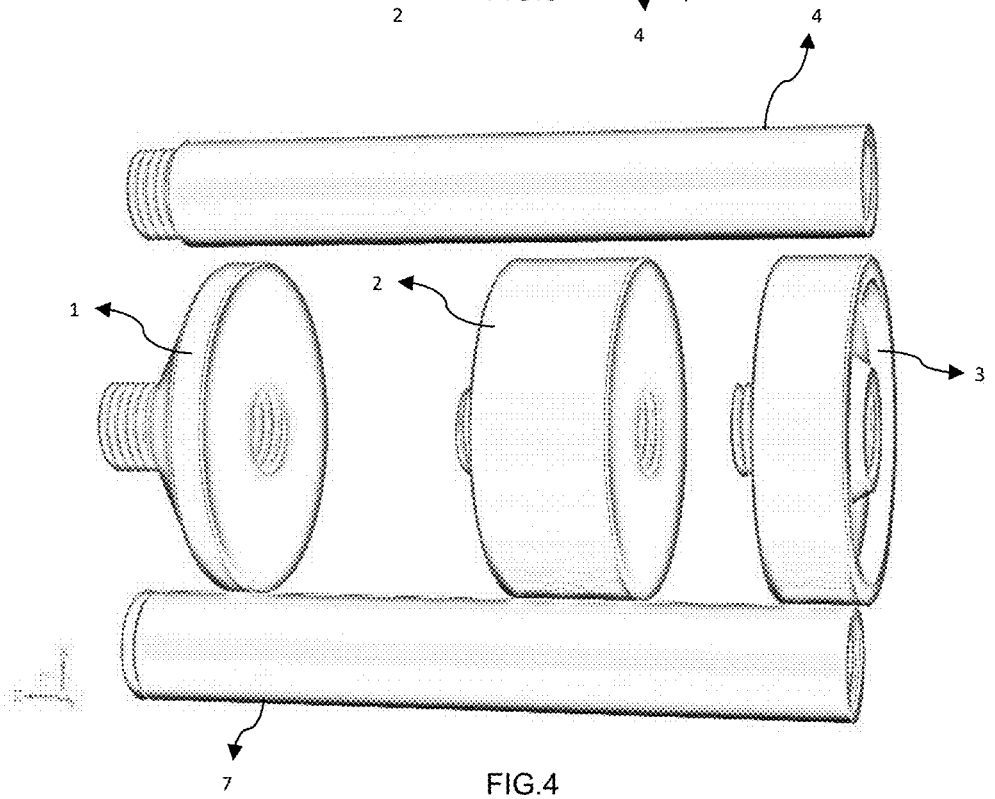
FIG. 4, is a close-up view of 5 components of embodiment A of the present invention.
Figure 12:
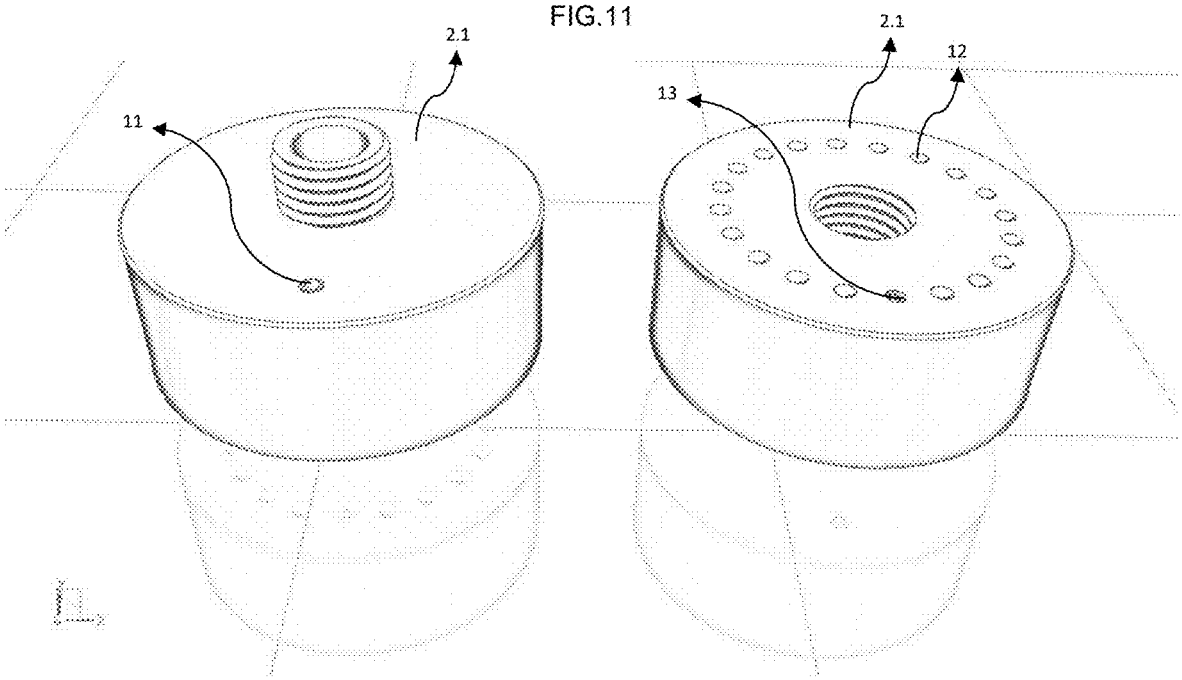
FIG. 12, shows a spring plunger thread lock solution having plurality of dents for preventing weights from loosening.

FIG. 1, Displays 6 different configurations for embodiment A of the present invention. FIG. 2, Displays the same embodiment in an unassembled configuration and FIG. 3, Displays a perspective view of embodiment A in packaging configuration which is labeled as embodiment A.P. A conic base 1 is used for connection between handles and weights. In case of the illustrated embodiment A, the conic base weighs 2.5 lb. There are 4 pcs of 5 lb weights 2, and an additional 2.5 lb weight 3. FIG. 4 is a close up view of a few of the components of the embodiment A. In case of the illustrated solution, the conic base and all the weights have a male M27 threaded connection on top and a female M27 threaded connection on the bottom. Both thread types are shown in FIG. 12. Embodiment A includes 2 sets of handles. There is a smaller set of handle sections 4 with an outer diameter of 32 mm/1.25". Each small handle section 4 has a male M27 connection at one end and a female M27 connection at the other side. The set of small handle sections 4 is accompanied with an end section 5. The end section 5 includes a cylindrical component 5.1 with 2 female threads at both ends and an end cap 5.2 at one end. An adapter 8 is presented with female M27 connection (inside) and male M36 connection (outside, at one end). The set includes a bigger handle set with outer diameter of 42 mm/1.65" and M36 connections including 3 pcs of 42 mm handle sections 6 and an end section 7. It should be clarified that normally the maces up to 10 lb have a smaller handle and the bigger ones have a bigger handle. Disclosed solution allows using both sizes of handles for all weights. The smaller handles may be more suitable for women and in general people with smaller hands. As can be seen in FIG. 3, the hollow male thread of bigger handles 6 and 7, allow the smaller ones 4 and 5 to slide into them. The mace head in general for embodiment A is labelled as HA.

Figure 5:
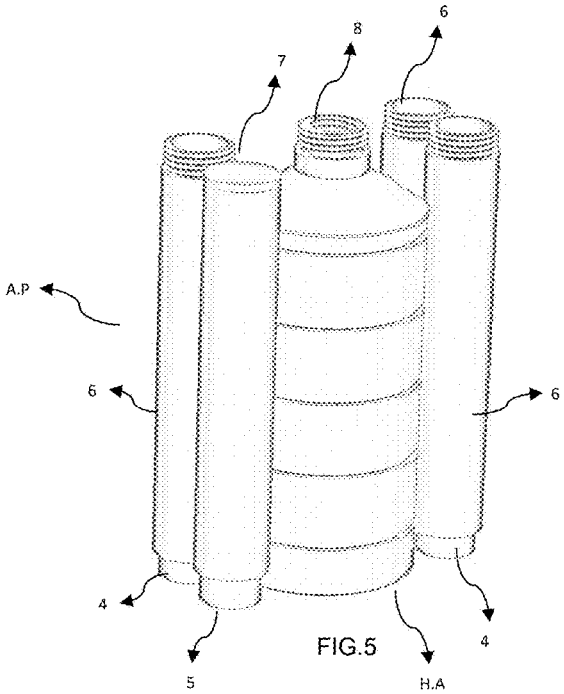
FIG. 5, Displays a perspective view of embodiment A of the present invention in packaging configuration alongside embodiment B.
Figure 6:
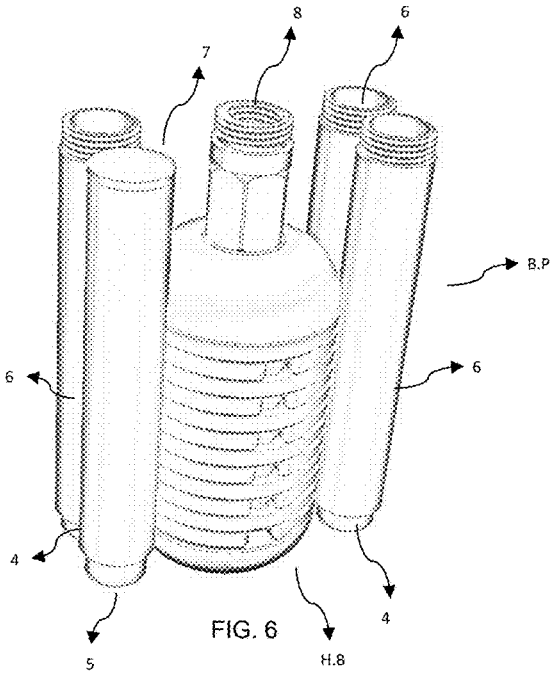
FIG. 6, Displays a perspective view of embodiment B of the present invention in packaging configuration alongside embodiment A.
Figure 7:
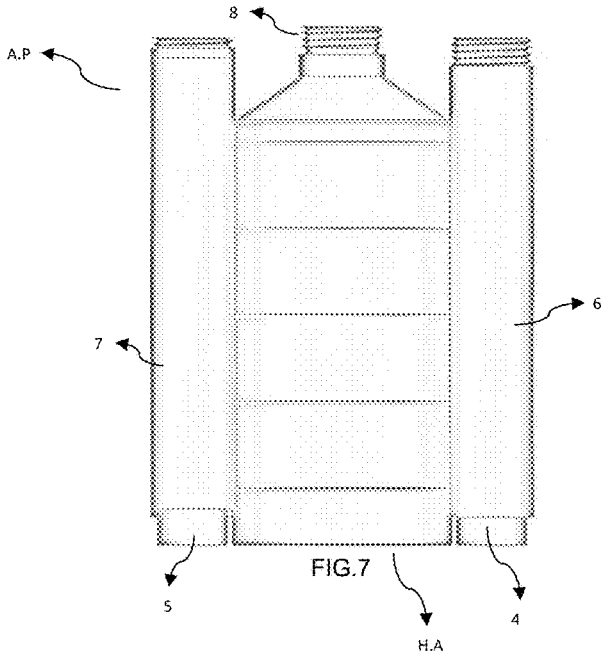
FIG. 7, Displays a front view of embodiment A of the present invention in packaging configuration alongside embodiment B FIG. 8, Displays a front view of embodiment B of the present invention in packaging configuration alongside embodiment A.
Figure 8:
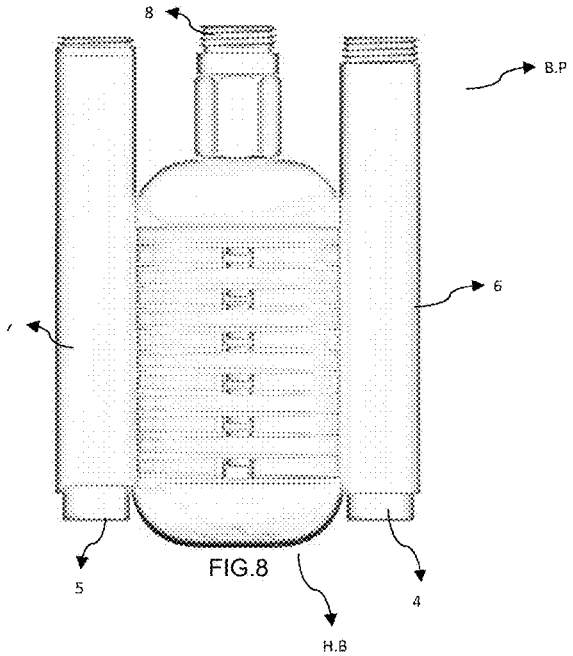
Figure 9:
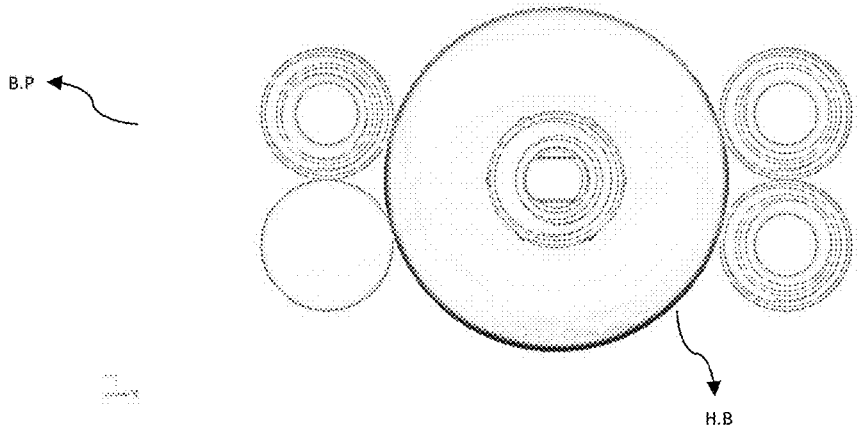
FIG. 9, Displays a top view of embodiment B of the present invention in packaging configuration.

The main benefit of the presented invention is packageability. Configuration A.6 of embodiment A according to FIG. 1 is 5 ft and 5 inches long which is too long for most people to use. However, the external dimensions of configuration A.P shown in FIG. 3 is only 9"×6.7"×3.9" and both weigh the same (up to 35 lb). Such small packaging dimensions allow fitting the whole package in a very compact carrying bag, a carrying case, a toolbox style case, a backpack, etc. A carrying backpack may be converted to carrying vest which may be used as a weight vest. Since the components of the presented embodiment weigh from 0.2 lb to 5 lb, they can be used as the weight components of a weight vest and be used for various workout sessions. The weight of the weight vest can be easily adjusted by the components of the modular mace. FIG. 5 and FIG. 7 display embodiment A.P which is embodiment A in packaging configuration. The mace head of embodiment A is labeled as H.A. FIG. 6, FIG. 8 and FIG. 9 display Embodiment B in packaging configuration which is labeled as B.P. The mace head for embodiment B is labeled has H.B.

While the presented embodiment A has standard threaded connections, it should be readily understood that every type of quick connection may be used for connection of these parts. There are many standard quick coupling and snap on connection types available in the market for example for connection of hydraulic connections those are very reliable. However, the failure of connection may be disastrous for mace application since dropping a weight may cause serious injury to the user (User toes for example). Threaded connection may not be the easiest connection to use but is the most reliable one.

Figure 10:
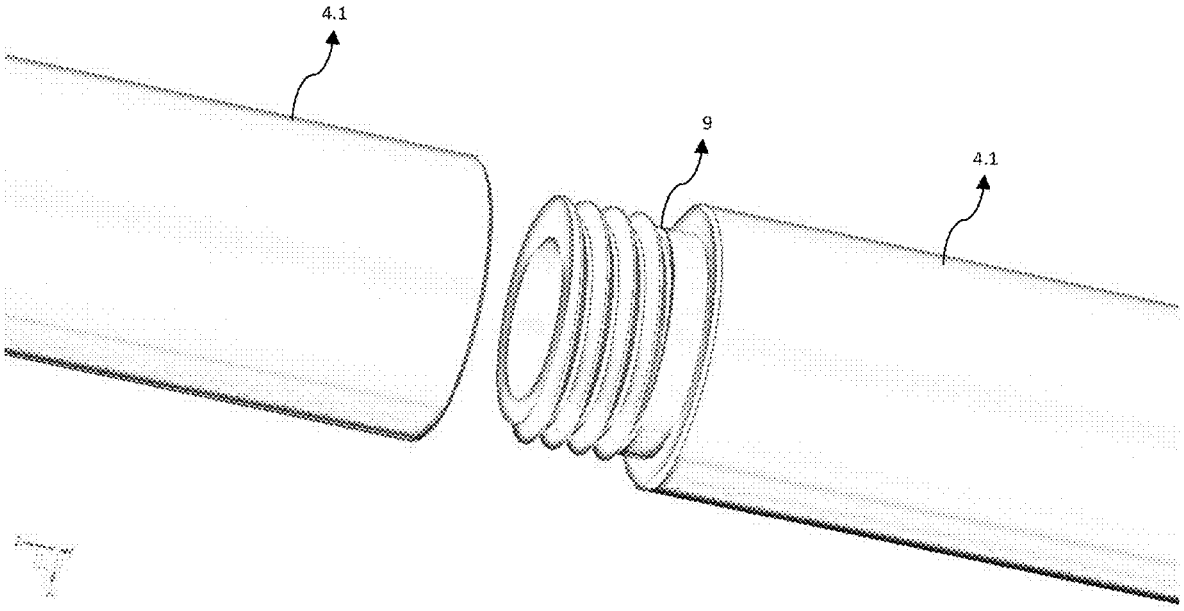
FIG. 10, Shows an elastic thread lock solution for connecting 2 components of the present invention.
Figure 11:
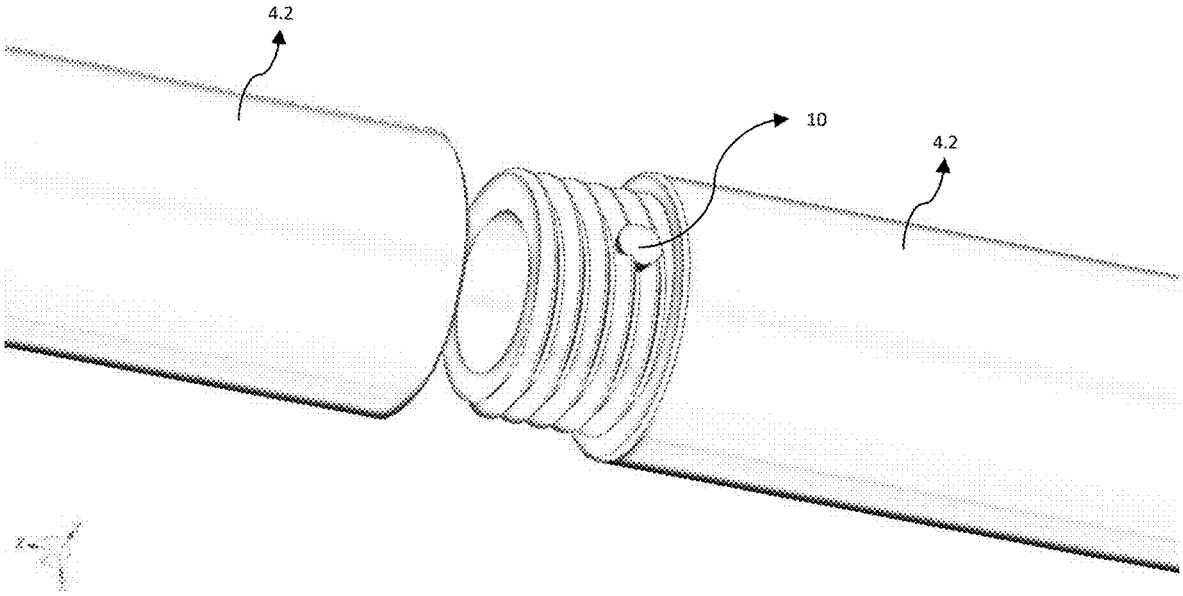
FIG. 11, Shows an elastic thread lock solution for connecting 2 components of the present invention.

One of the problems of threaded connections is that they tend to get loose during application. There are various solutions to lock the threaded connections. A proposed solution is using an elastic stopper. When 2 components are connected by a threaded joint, an elastic component may be fixed to the first one in order to create friction with the second one in order to prevent it from loosening. A common method is using a nylon insert inside the female connection which is known as nyloc solution. However, it is possible to add a nylon self-locking insert to the both female or the male part of the threaded connection. Nylon self-locking inserts are standard re-usable products and are made by many companies. ND Industries is an American company which has developed such inserts in many different shapes. FIG. 10 proposes using a nylon collar 9 on the male part of threaded connection. The placement of the collar is so that only the last 1-2 turns engage the elastic stopper. Thus the handle sections 4.1 can be easily rotated by hand until the last turns. FIG. 11 proposes another type of self-lock nylon insert 10. The handle sections can again be rotated freely until the last few turns.

Figure 13:
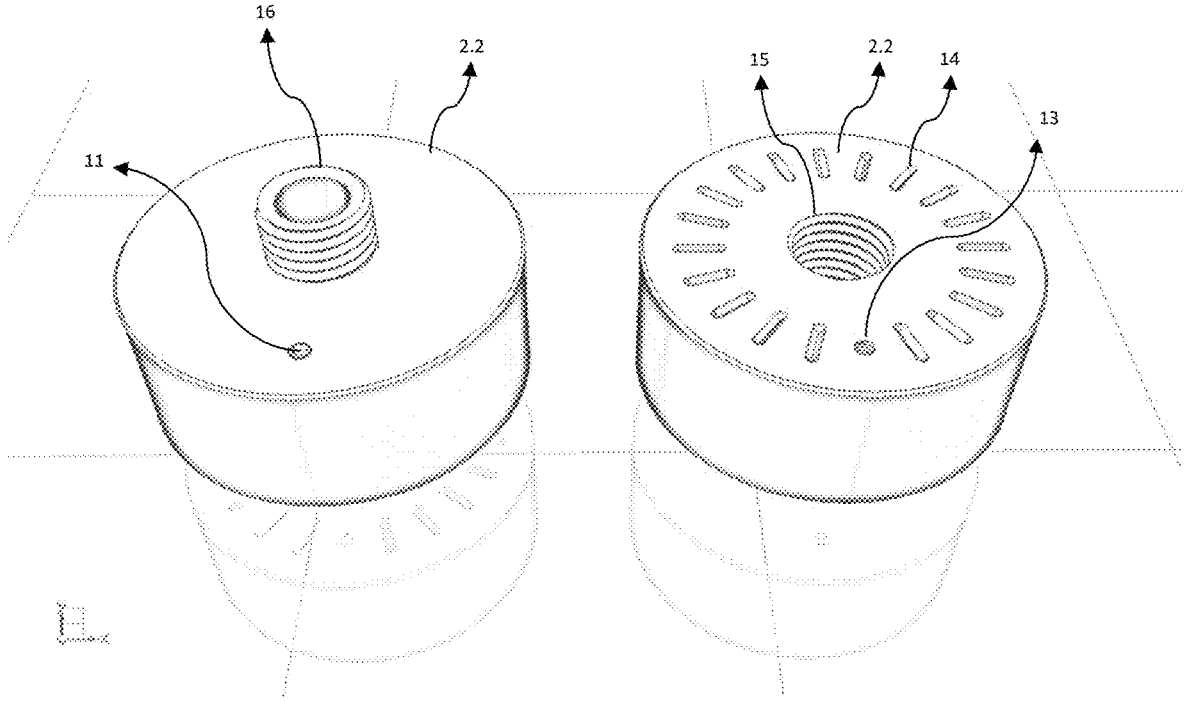
FIG. 13, shows a spring plunger thread lock solution having plurality of linear radial dents for preventing weights from loosening.

While nylon inserts can be used both for the handles and the weights, another solution for weights is using spring plungers. FIG. 12 displays using a spring plunger 11 on a 5 lb weight 2.1. Both sides of the weight 2.1 are shown in the figure. The weight has some dents 12 on the other side those get engaged with the spring plunger 11. While the spring plunger is spherical, the displayed dents are conic and can be made by the tip of a drill bit or by a hydraulic press. It should be kept in mind that unlike a socket, the dent and the plunger tip do not need to have the same shape to cause enough friction to keep the weight immobile. Different types of dents can be made using a hydraulic press. A threaded hole 13 is displayed which is used for assembly of the spring plunger 11. FIG. 13 displays a 5 lb weight 2.2 with radial linear dents 14. While the spring plungers normally have a round or conic tip, It is possible to use a spring plunger with a flat rough tip and rely on friction only for locking the thread and omit the dents. The matching surface of the weight may also have a rough surface to create more friction. Knurling the weight surface is a proposed solution in order to create more friction and result a dented surface. The tip of the spring plunger may also be made of rubber or nylon those may cause enough grip for the weight, which itself may be coated by rubber.

The suggested solution for production of the threaded connection of weights 2, 2.1 and 2.2 is making a through female threaded hole 15 extended throughout the whole height of the weight, and putting an externally threaded rigid or hollow shaft 16 in one side of the weight. Said threaded shaft should be locked inside the female thread preferably using a liquid thread locker (e.g. Loctite).

Figure 14:
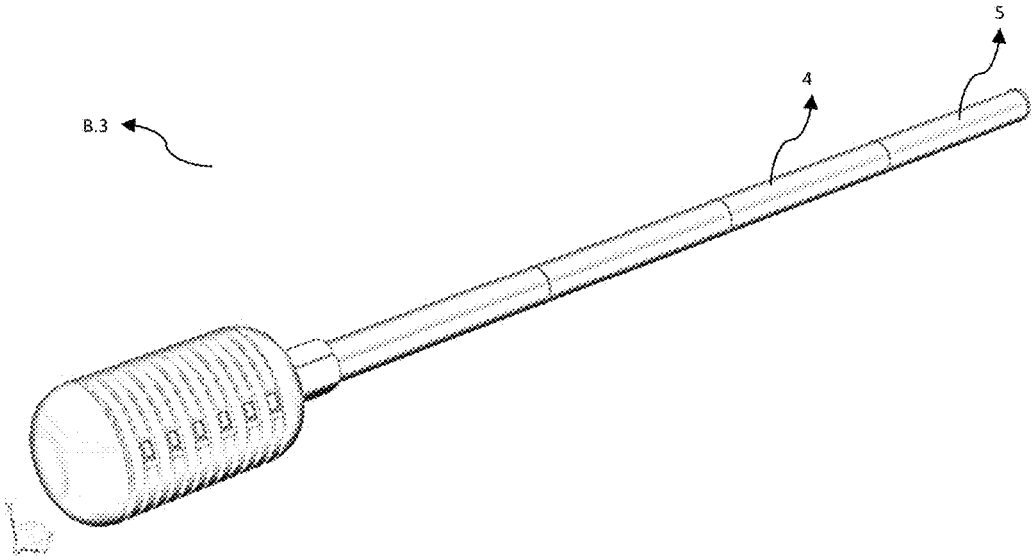
FIG. 14, shows a perspective view of embodiment B of the present invention almost fully loaded configuration labeled as B.3.
Figure 15:
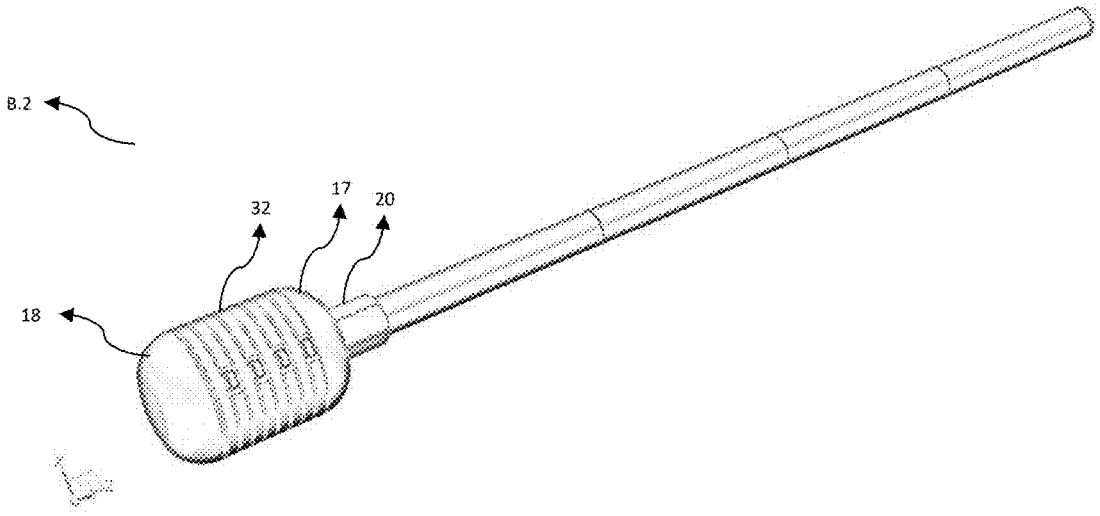
FIG. 15, shows a perspective view of embodiment B of the present invention partially loaded with weights labeled as B.2.
Figure 16:
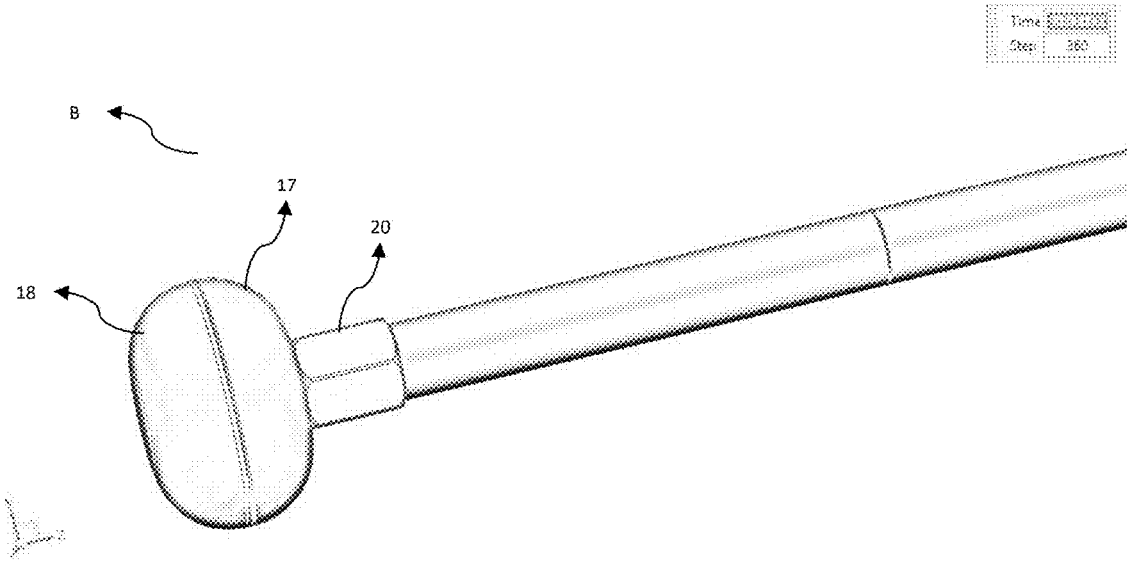
FIG. 16, shows a perspective view of embodiment B of the present invention with no weights.
Figure 17:
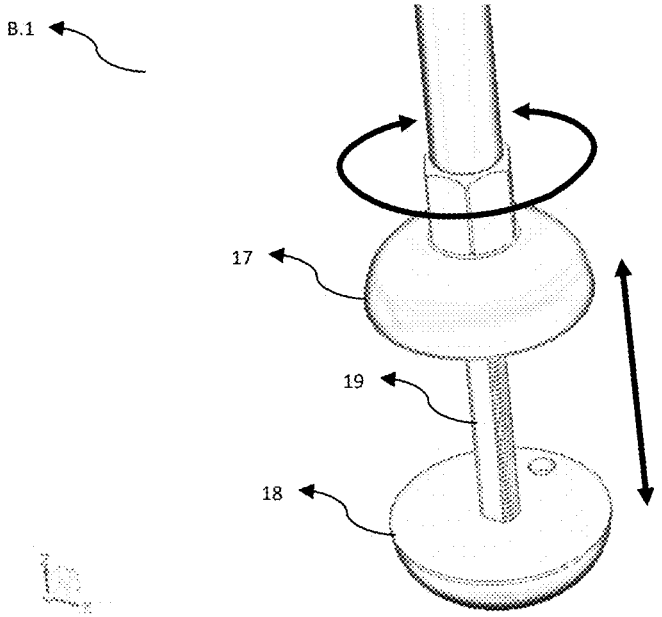
FIG. 17, shows the operation method of embodiments B of the present invention.

FIG. 14 to FIG. 39 illustrate different variations of embodiment B of the present invention. Embodiment B is a "Secured modular quick coupling system" configured to receive various modules, said modules being one of an object and a device such as but not limited to a weight, a vibrator, a sensor, a flashlight, a housing, a fillable housing, a speaker, a Bluetooth speaker, a memory storing device, a battery, a processor, a display, a form of fire container, a decorative module, said "Secured modular quick coupling system" comprising a vice like mechanism (which is displayed as B.1 in FIG. 17) including a fixed jaw 17 and a movable jaw 18 having 1 degree of freedom in relation to each other and. FIG. 14, Displays a perspective view of embodiment B.3 a fully loaded configuration of embodiment B of the present invention. FIG. 15, Displays half loaded configuration of the same embodiment marked as configuration B.2., while FIG. 16 shows not loaded configuration with closed jaws which is the lightest possible configuration. FIG. 17 shows it with open jaws. While presented as the mace head H.B for embodiment B, the disclosed solution may be used as a universal variable weight system for many different workout devices. Embodiment B has a fixed jaw 17, also cited as core in this document, and a movable Jaw 18. The movable jaw 18, has a central flat-sides threaded rod 19 which has 2 flat-sides. The cross section of the threaded flat-sides rod 19 can be seen in FIG. 23 to FIG. 25 and FIG. 78. As the mentioned figures illustrate, the rod has two opposite parallel flat sides 116, and two opposite cylindrical threaded sides 113. The flat sides allow the rod axially slide in a slider joint 23 while preventing it from rotation. A slider joint is a well-known joint which only allows linear movement of components in relation to each other with no rotation. Thus, degree of freedom of said jaws in relation to each other is 1. Therefore, the movable jaw can only slidingly move in relation to the fixed jaw. Throughout this document, the direction of a longitudinal central axis of said threaded flat sides rod 19, is referred as axial direction of the mechanism. Thus, any vector which is perpendicular to said axis may be considered to have a radial direction. For simplicity, a radius of the cylindrical sides of the threaded rod is considered to define a radial direction of the vice-like mechanism. There is an adjustment nut 20 which is connected to the fixed Jaw 17 by a revolute joint. FIG. 17 displays how rotation of the adjustment nut 20 moves the movable jaw 18. Each jaw further comprises at least one opening 33 and 34 to receive an axial guiding pin 30 from a module.

Figure 18:
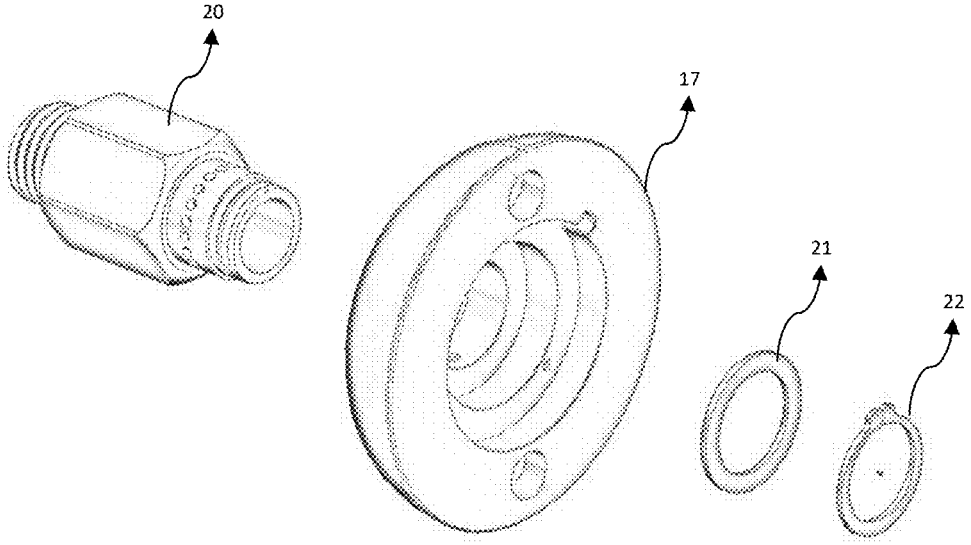
FIG. 18, shows an exploded view of the revolute joint between the core and main nut of the embodiment B of the present invention.

FIG. 18, Displays the revolute joint between the nut 20 and core/fixed jaw 17. An external circlip 22 and a flat washer 21 are used to retain the nut connected to the core 17.

Figure 19:
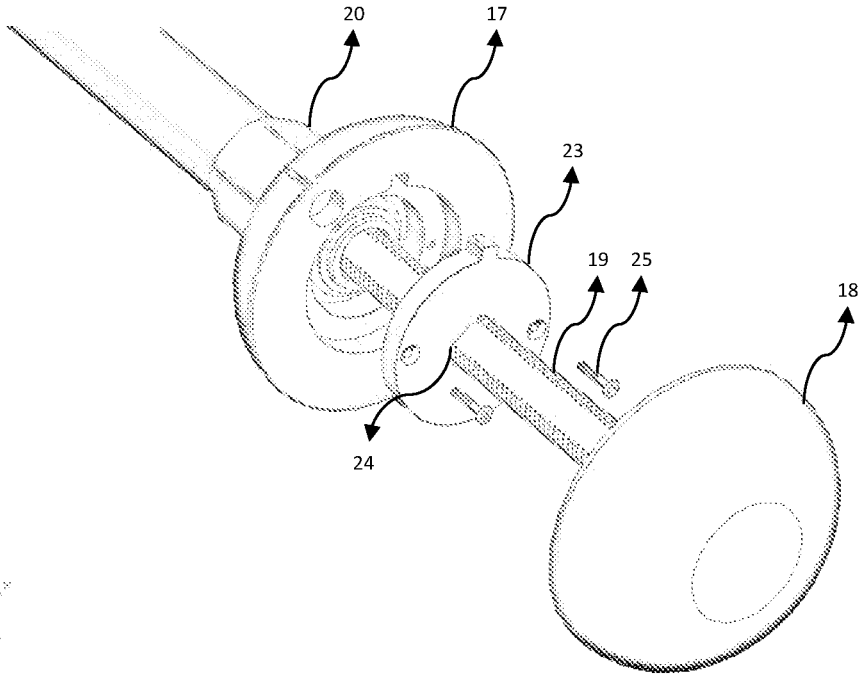
FIG. 19, shows an exploded view showing assembly of the slider joint between the core and the flat-sides rod of embodiment B of the present invention.

FIG. 19, Displays a slider joint between the moveable jaw's flat-sides rod 19 and core 17 of embodiment B of the present invention. A slider joint 23 has an internal sliding slot 24 and is fixed in place using two screws/bolts 25.

Figure 20:
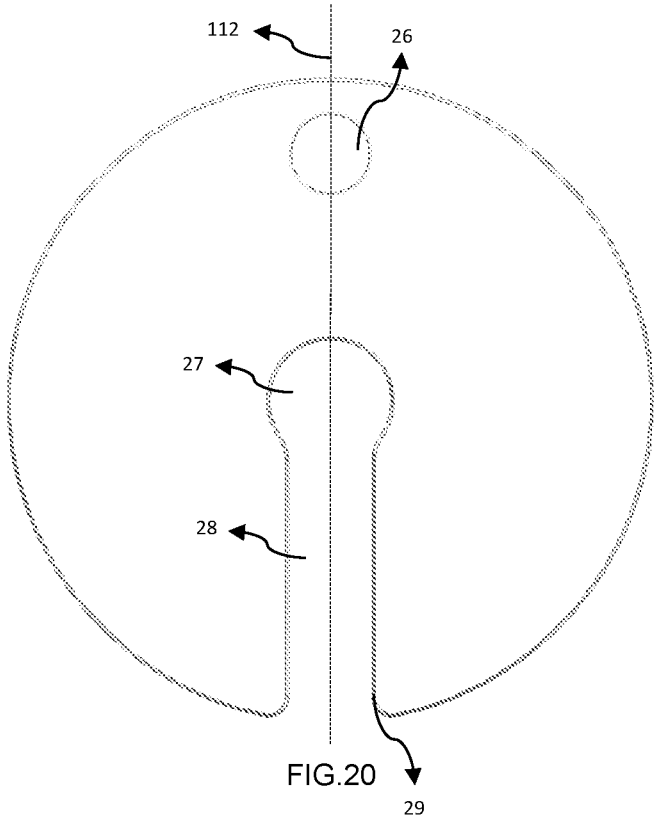
FIG. 20, shows the a suggested profile of laser cut plate of a weight for embodiment B of the present invention.

FIG. 20, Displays the profile of a weight 32 for embodiment B. The displayed part is a laser cut plate acting as a weight. Since steel plates are among cheaper steel products, and laser cutting is now considered a cheap process, the weights will cost reasonably low if being made of steel plates. However, the material of the components does not limit this invention unless clearly stated in the claims of the non-provisional application. The outer shape of the displayed weights/modules has a circular shape. However, it may be produced in other shapes too, for example it may be pentagonal, hexagonal octagonal, rectangular, rectangular with round edges, etc. While the weight may be made generally in a polygonal outer shape, it is preferred to have odd number of sides in order to maintain symmetry which allows easier stacking of the weights/modules. Displayed part has a hole 26 for an axial guiding pin, a circular cut at the center 27 in the form of an axial hole 27, and a sliding track 28 in the form of a slot extended from a perimeter of the module to said axial hole. The width of said track/slot 28 defined by slot walls 29 is just slightly bigger than the width 115 of the threaded rod 19 on the flat sides which may be referenced as "the width of the threaded rod" 115, but smaller than the outer diameter 114 of the cylindrical sides of the threaded rod. Thus, a module can slide between two jaws, while the slot 28 slides around the flat sides of the threaded rod 19. A module cannot rotate around the threaded rod while the threaded rod is inside said slot 28. However, when the threaded rod 19 enters the cylindrical hole 27, the module can rotate. In case of the embodiment provide in FIG. 20 the hole for the axial guiding pin 26, and subsequently the axial guiding pin 30, The axial hole 27, and the slot 28 which also acts as a receiving opening for an axial guiding pin 30, are all aligned on one imaginary line 112. Thus, when a second module is staked on a first module, it should be rotated around the threaded rod by 180 degrees so that the axial guiding pin of the second module can be positioned inside the receiving opening of the first module.

Figure 21:
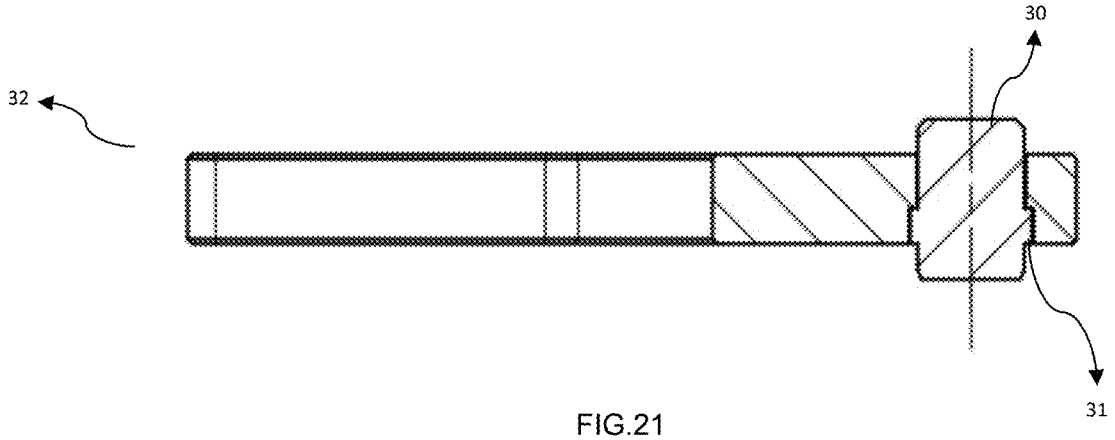
FIG. 21, shows a cross section of a weight for embodiment B of the present invention.

A weight assembly 32 having an axial guiding pin 30 is shown in FIG. 21. One end of the hole 26 may be widened. It may be simply done by a milling cutter. The axial guiding pin 30 may have an enlarged portion 31 to fit inside the enlarged portion of the hole. It makes the assembly much easier and more precise. The axial guiding pin 30 may be fitted inside the hole 26 by a hydraulic press (pin should be slightly larger than the hole), may be glued inside the hole (needs to be slightly smaller) or have a threaded connection with the weight plate, etc. In case of embodiment B, making heavier weights is possible by using thicker plates, which may look similar to the module 99 shown in FIG. 67. The weights may also be made by casting in case of heavier weights or being cut by a hydraulic punch in case of lighter ones.

Figure 22:
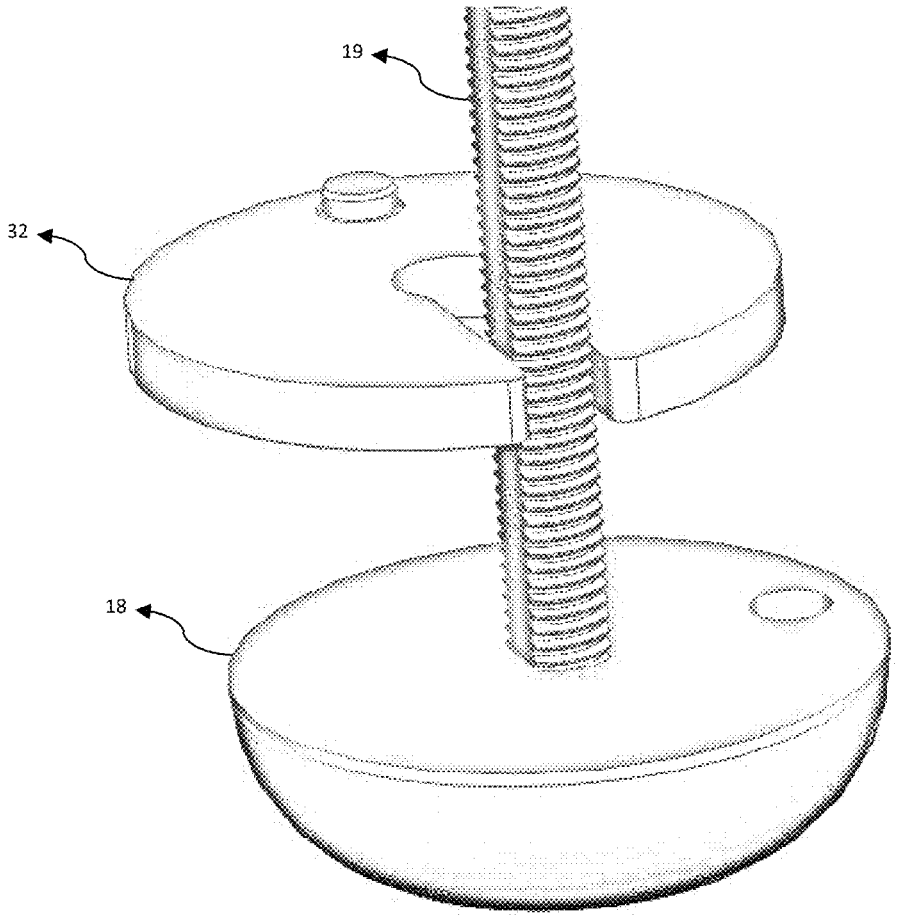
FIG. 22, illustrates sliding a weight on the flat-sides rod of embodiment B of the present invention.
Figure 23:
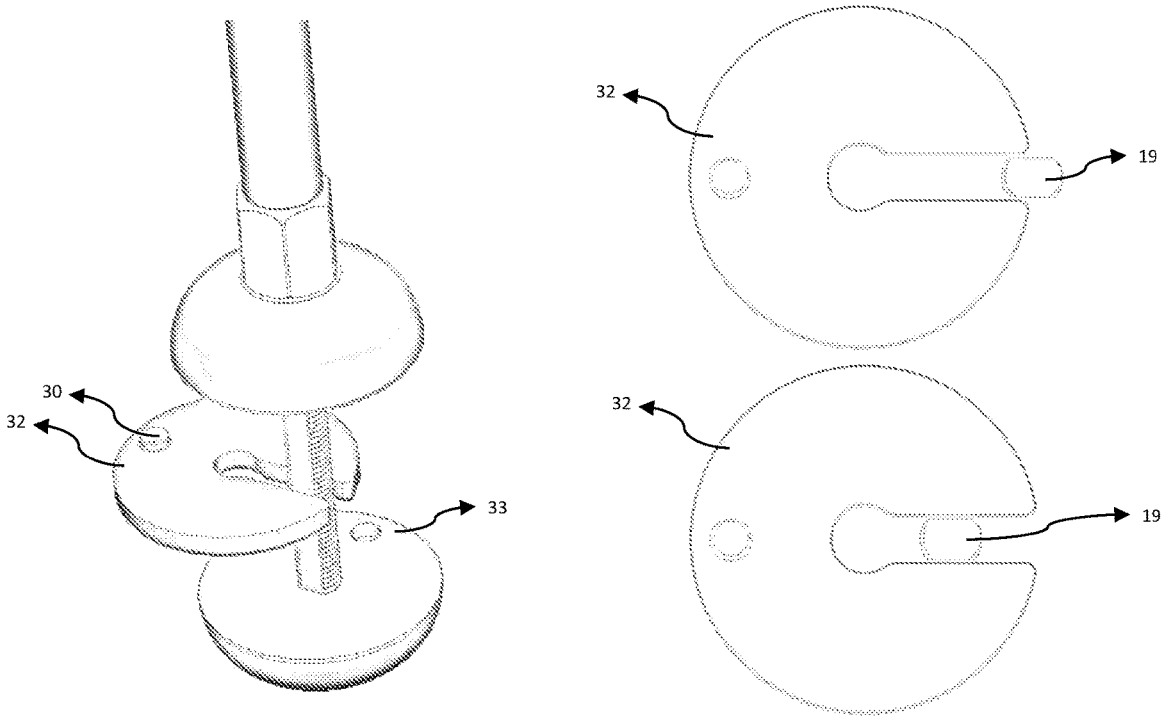
FIG. 23, illustrates early stages of sliding a weight on the flat-sides rod of embodiment B of the present invention.

FIG. 22 and FIG. 23, display how a module/a weight assembly 32 is slid on the flat-sides threaded rod 19. Similar to the module illustrated in FIG. 20, every module has a cylindrical hole in the form of circular cut at the center 27 and a sliding slot/track 28 The dimensional tolerance of the sliding track 28 should be enough to allow a smooth sliding of the weight assembly 32. FIG. 23 displays the sliding process from different angles and positions. An axial guiding pin hole/receiving opening 33 is also displayed on the movable jaw. While only 1 pin guiding hole/receiving opening 33 is displayed, it is possible and preferred to have another hole in the opposite side of the flat-sides rod 19 too.

Figure 24:
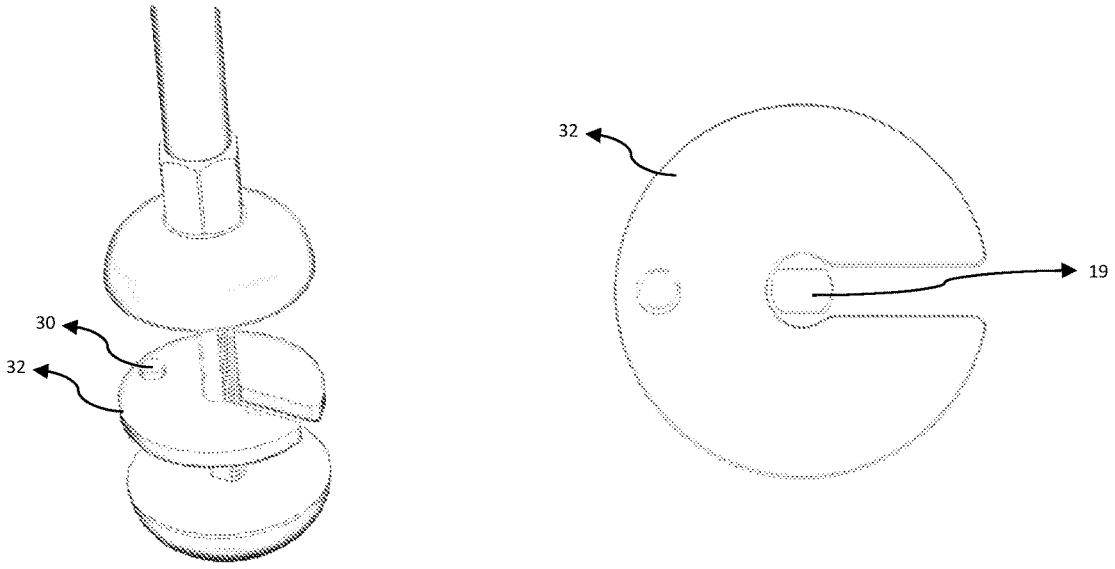
FIG. 24, shows a weight completely slid on the flat-sides rod of embodiment B of the present invention but not locked.
Figure 25:
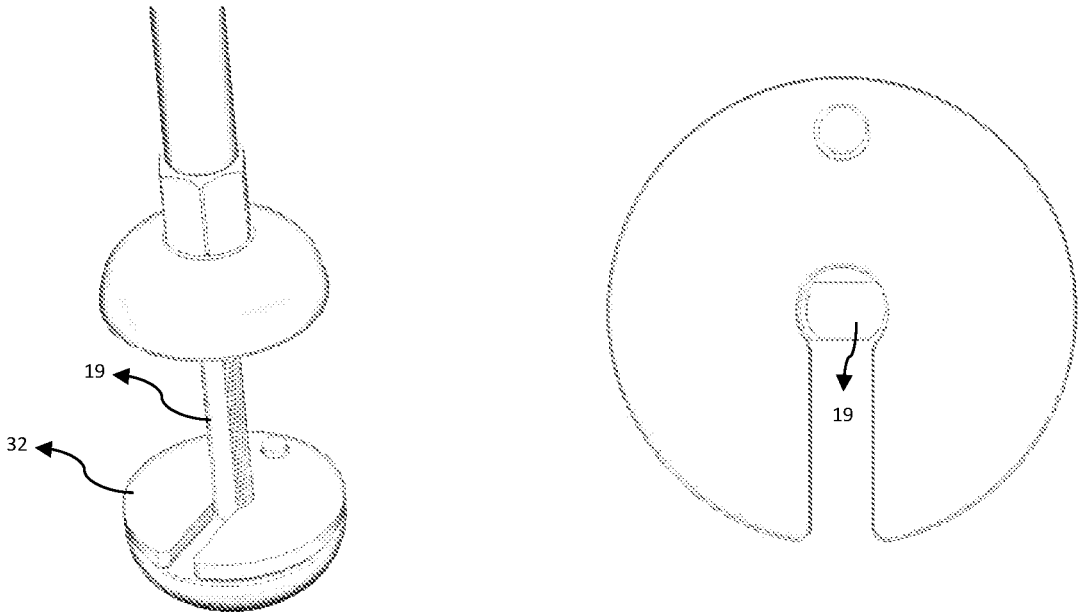
FIG. 25, shows a weight rotated and locked on the flat-sides rod of embodiment B of the present invention.

FIG. 24, Shows the weight/module assembly 32 fully slid on the flat-sides rod 19. In this position the weight is still loose and can be slid back out. FIG. 25 displays the same weight 32 rotated by 90 degrees. In this position the weight/module is radially locked on the flat-sides rod 19 and cannot be slid out. This position is called engaged position. However, it may still slide axially on the flat-sides rod. In this figure the weight is also axially slid downward and positioned on the movable jaw, with the axial guiding pin 30 securely placed inside the guiding hole/receiving opening 33.

Figure 26:
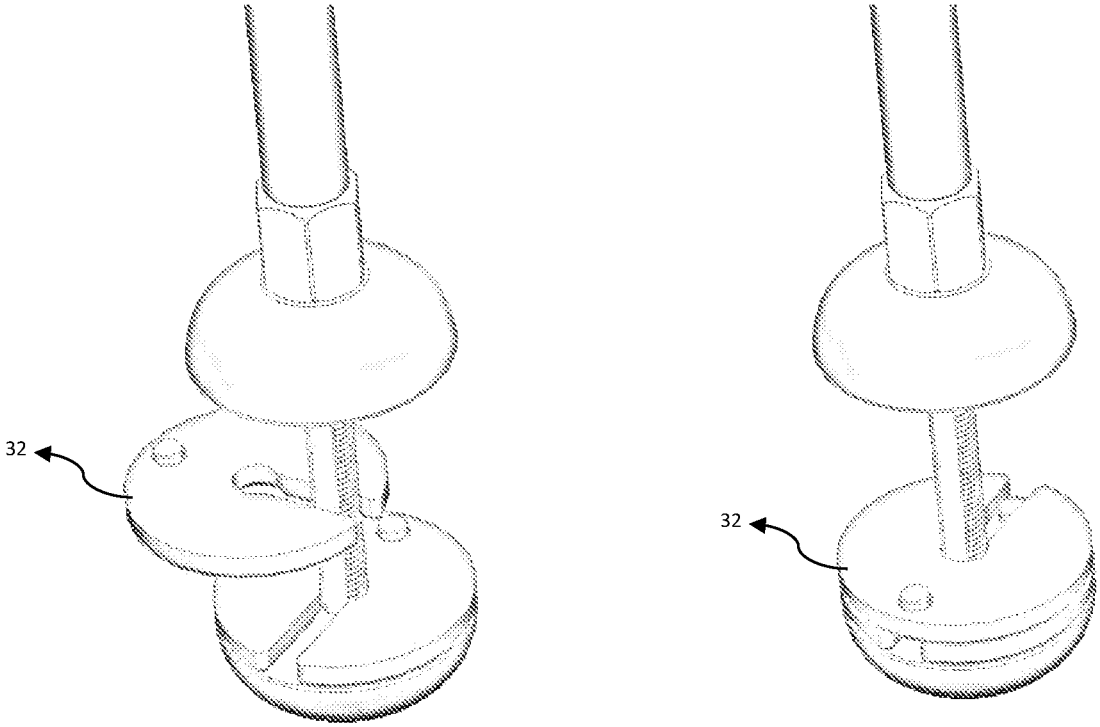
FIG. 26, shows loading the second weight on the embodiment B of the present invention.

FIG. 26, Shows how a second weight/module assembly 32 may be stacked on the first weight/module. Having 2 axial guiding pin extensions on 2 sides of the weight assembly 32 only allows the weight to be placed in 1 position, where the 2 weights embrace each other having 1 end of an axial guiding pin of each weight, placed securely inside the sliding track of the other weight 28. The loading process is perfectly fool proof and cannot go wrong. The weights rotation and radial movements are locked, and they will be securely locked when the jaws are closed, allowing no jiggling or vibration and guarantee a safe training session.

Figure 27:
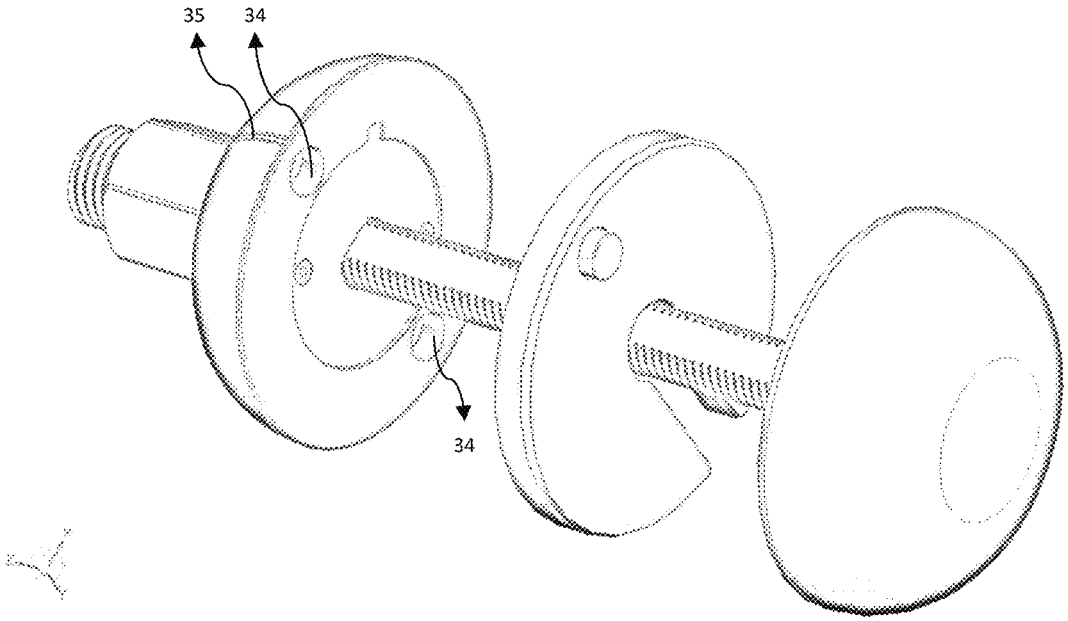
FIG. 27, shows a suggested visual sign on the core for aligning the alignment pins of the weights of the embodiment B of the present invention.
Figure 28:
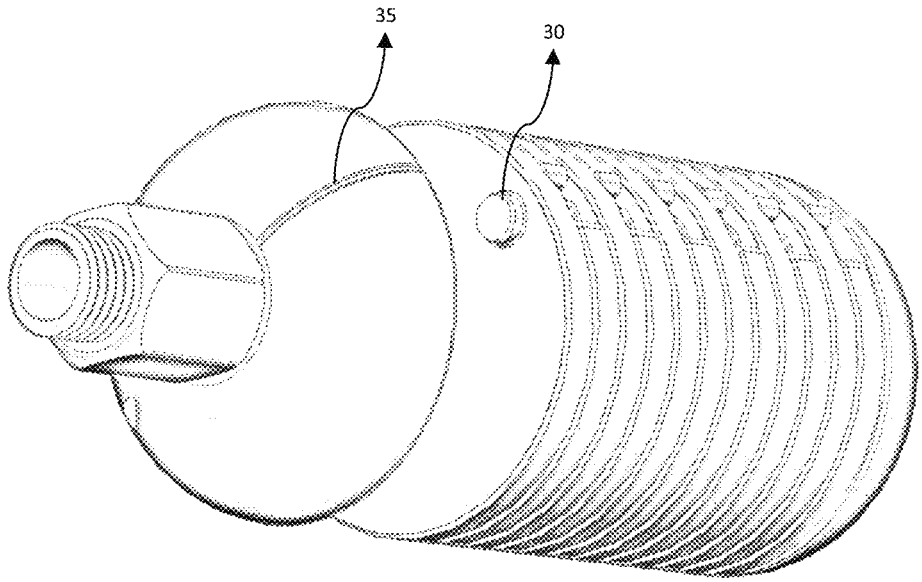
FIG. 28, shows a suggested visual sign on the core for aligning the alignment pins of the weights of the embodiment B of the present invention.

FIG. 27, shows two receiving openings 34 on the fixed jaw 17 (core). A visual sign 35 can also be seen which is aligned with one of the receiving openings 34. FIG. 28 displays how such a visual sign may look from upside, and how it assists the user for aligning the weights and knowing the position of the receiving openings 34 from upside.

Figure 29:
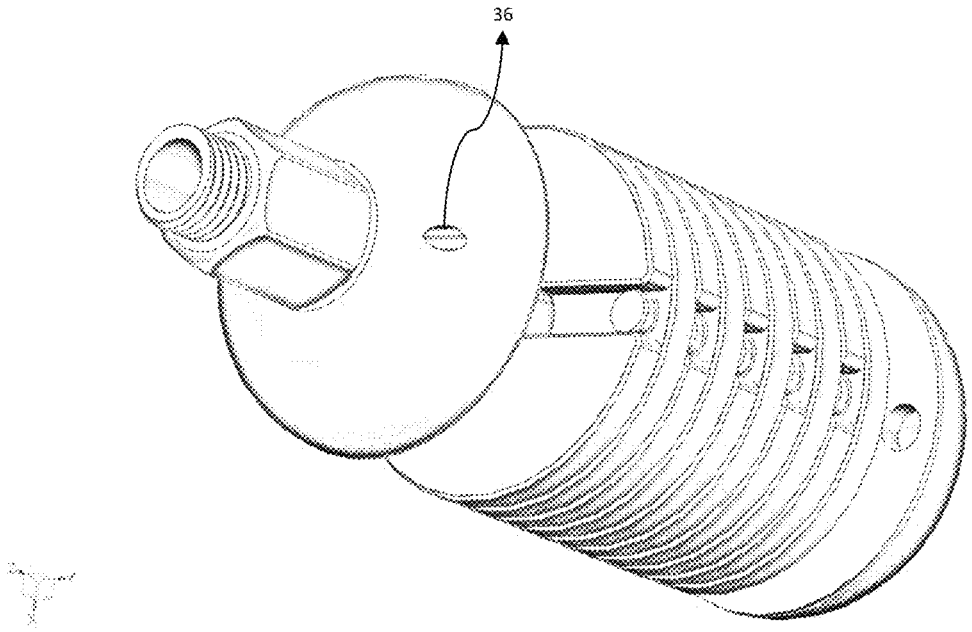
FIG. 29, shows a suggested solution using the hole of a spring plunger as an visual sign on the core for aligning the alignment pins of the weights of the embodiment B of the present invention.
Figure 30:
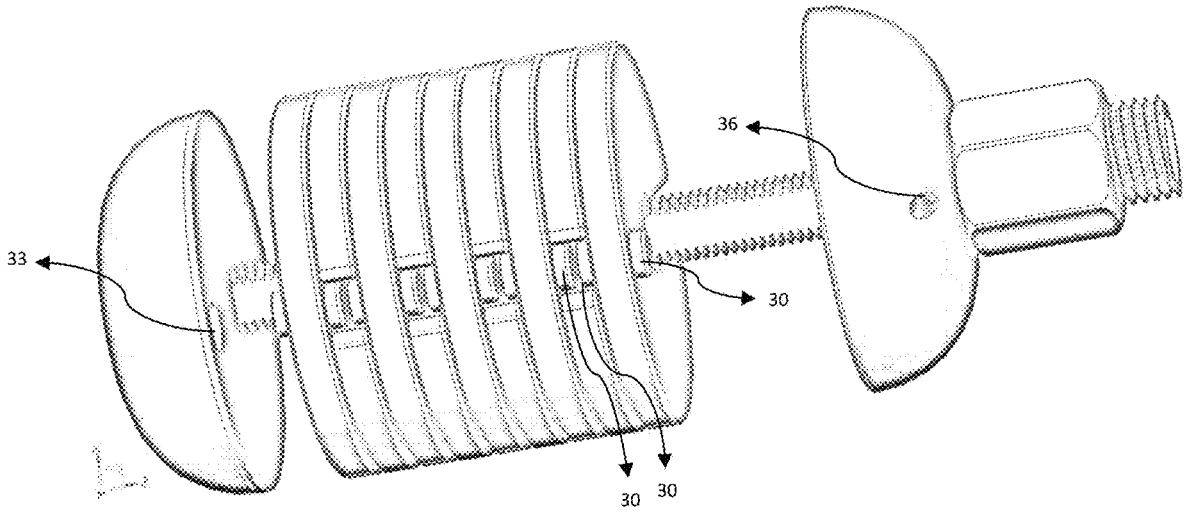
FIG. 30, shows alignment of the locked weights with alignment hole of the end-weight assembly and the spring plunger hole on the embodiment B of the present invention.

FIG. 29, shows how a spring plunger hole 36 can be used as a visual sign for when aligned with the guiding pins/holes 30, 33 and 34. FIG. 30 displays the alignment of guiding pins/holes with said visual sign 36.

Figure 31:
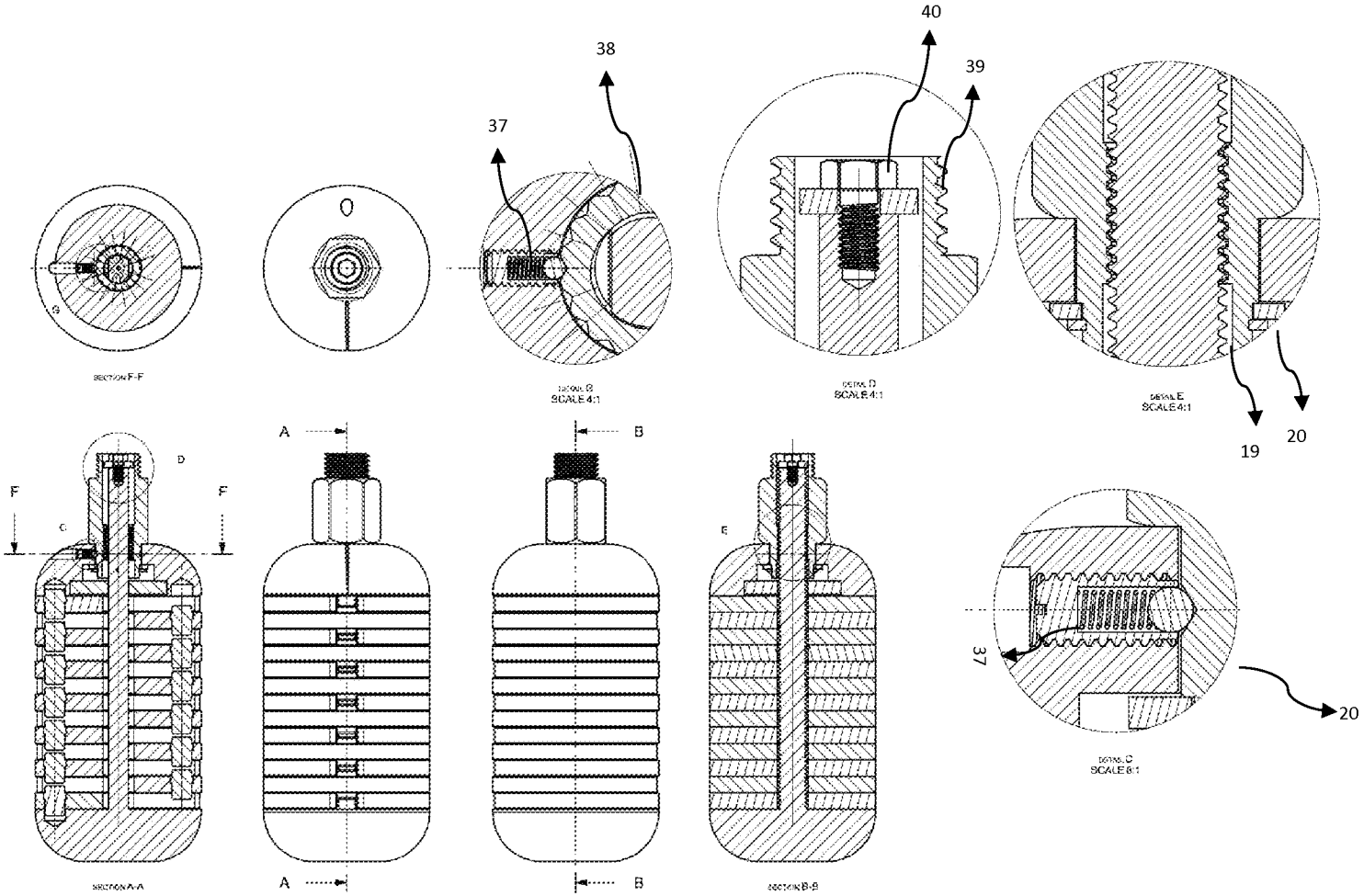
FIG. 31, is a technical drawing of the embodiment B of the present invention.

FIG. 31, is a technical drawing of the head of the embodiment B of the present invention. A spring plunger 37 is engaged with plurality of dents 38 on the main nut 20. A retaining washer 39 is bolted to the end of the flat-sides rod 19 by the means of a bolt 40 and prevents the movable jaw from being dropped from the nut.

Figure 32:
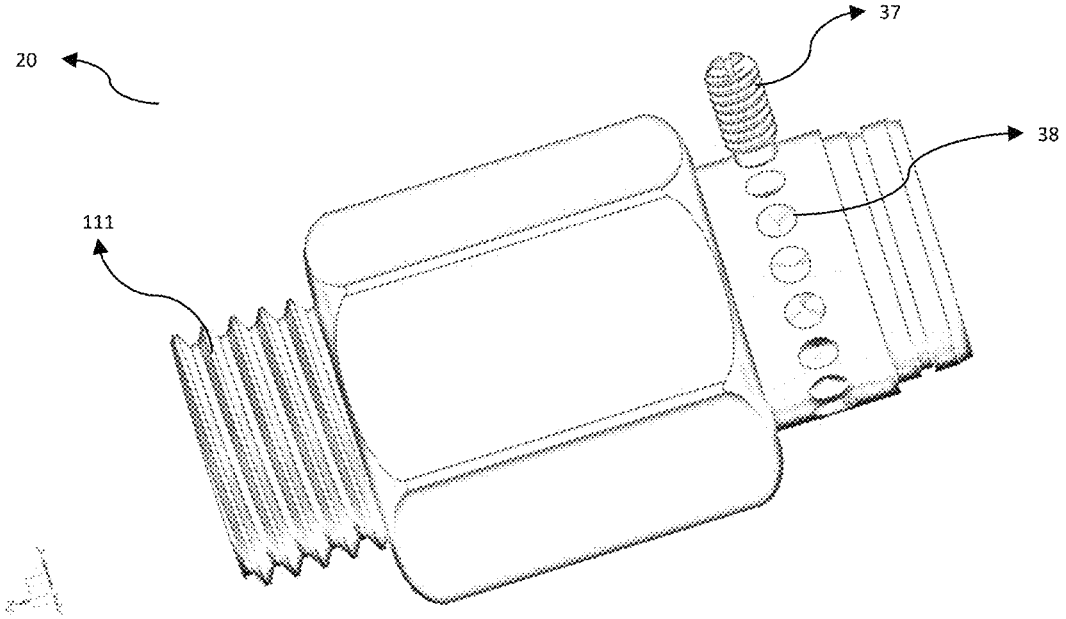
FIG. 32, shows relation between a spring plunger and the main nut of the embodiment B of the present invention.
Figure 33:
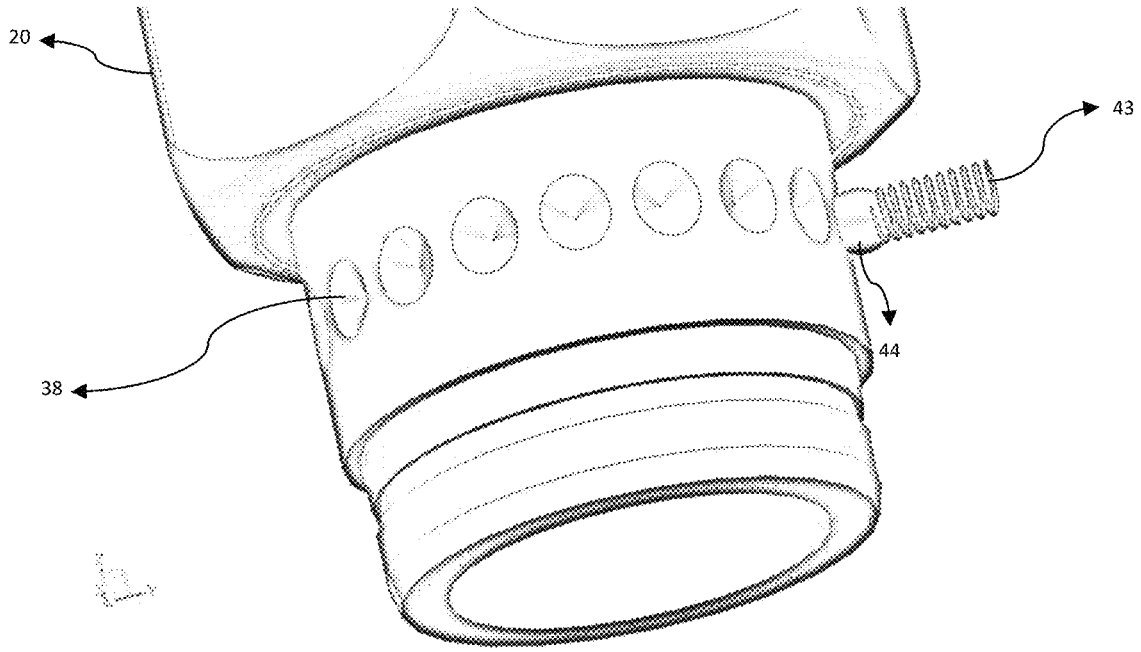
FIG. 33, shows the ball and spring of a spring plunger, and the main nut of the embodiment B of the present invention.

FIG. 32, shows how a spring plunger 37 is engaged with the dents 38 on the nut 20 and creating a ratchet mechanism. Also a mechanical connection 111 is displayed which may be used for connecting various handles or attachments. FIG. 33 displays internals of a typical spring plunger 37 including a spring 43 and a ball 44.

Figure 34:
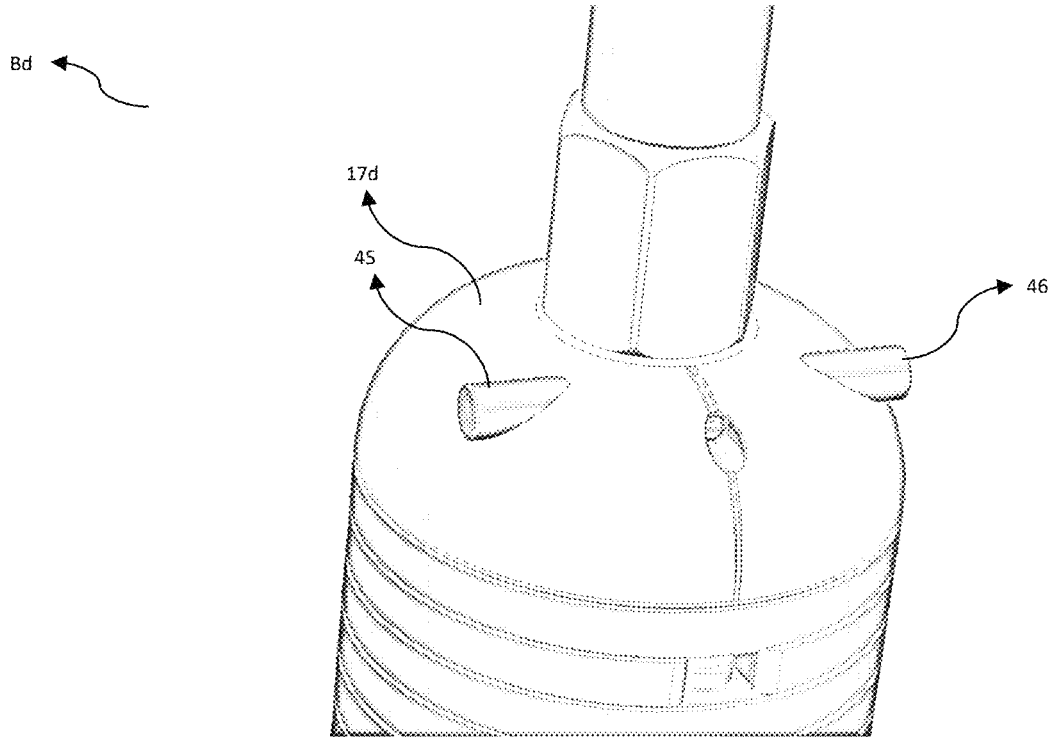
FIG. 34, shows a mechanical release solution for a spring plunger.
Figure 35:
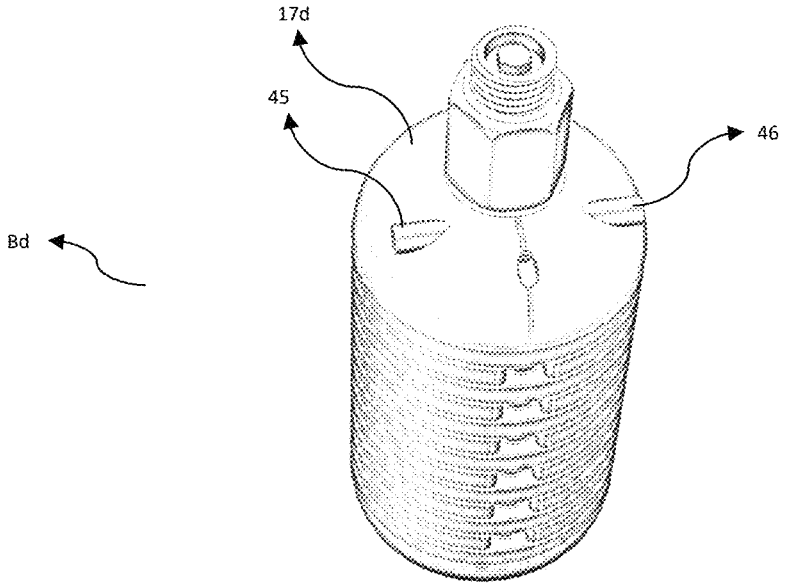
FIG. 35, shows a mechanical release solution for a spring plunger.

While a spring plunger is a good solution to avoid loosening of the weights, it makes noise which may not be desirable in all conditions, for example if the user intends to workout in a silent environment, and has the intention to fully unload the mace. It may make a lot of noise. A proper solution is having a mechanical release for the spring plunger. FIG. 34 displays embodiment Bd having a mechanical release solution. A release button 45 on the core 17*d* releases the spring plunger. Another button 46 re-engages the spring plunger. FIG. 35 displays the complete mace head of embodiment Bd.

Figure 36:
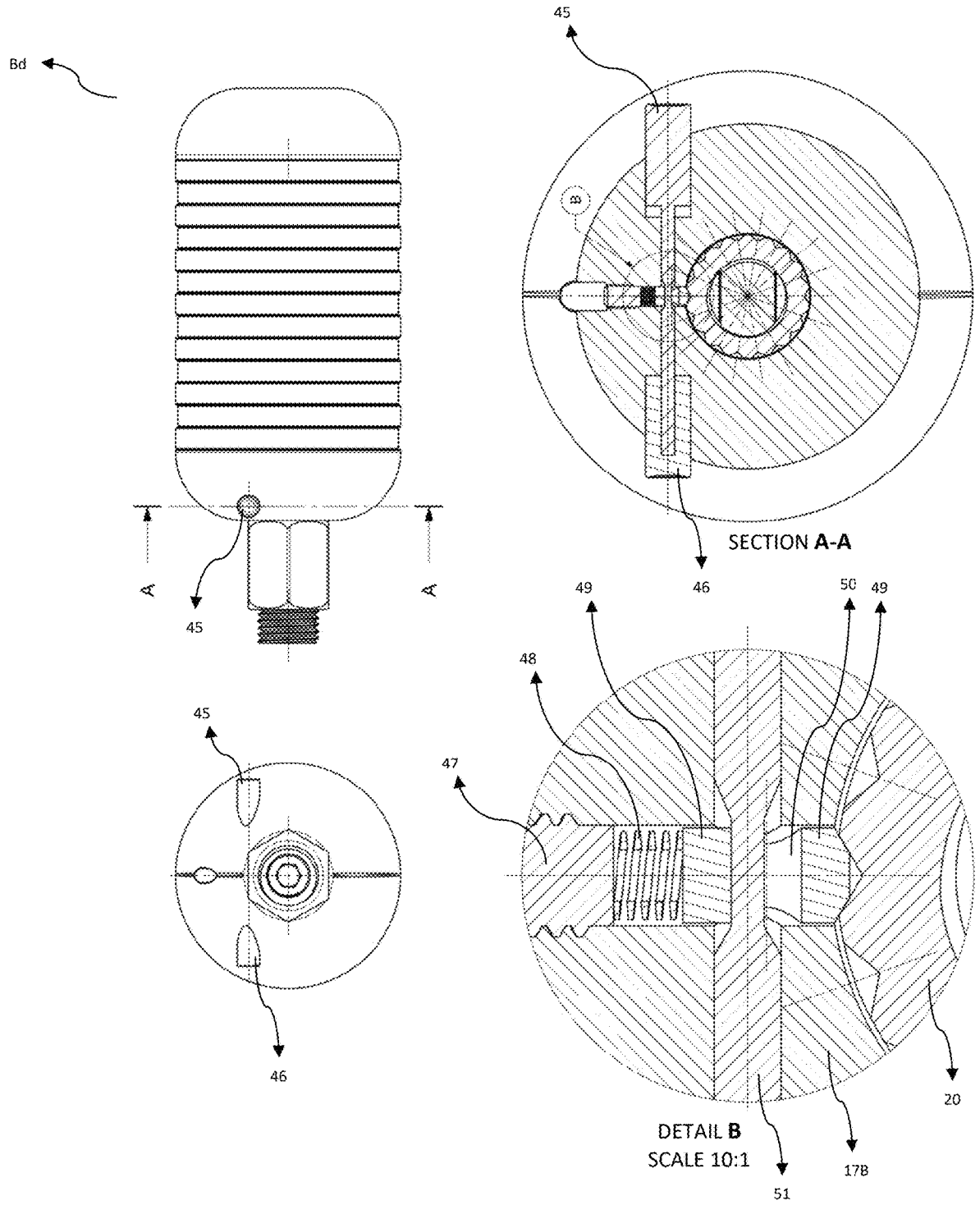
FIG. 36, is a technical drawing of a mechanical release solution for a spring plunger in engaged position.
Figure 37:
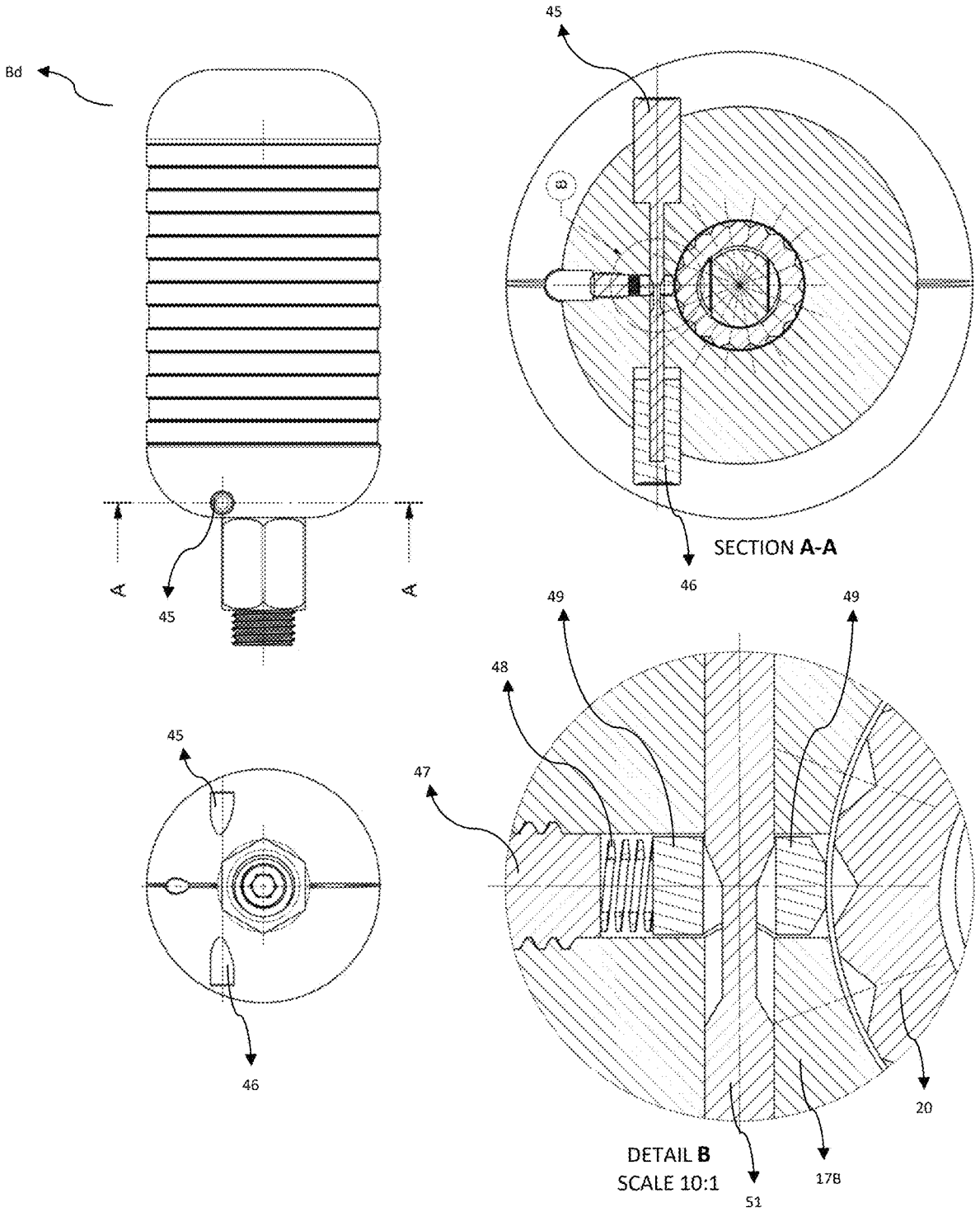
FIG. 37, is a technical drawing of a mechanical release solution for a spring plunger in disengaged position.
Figure 38:
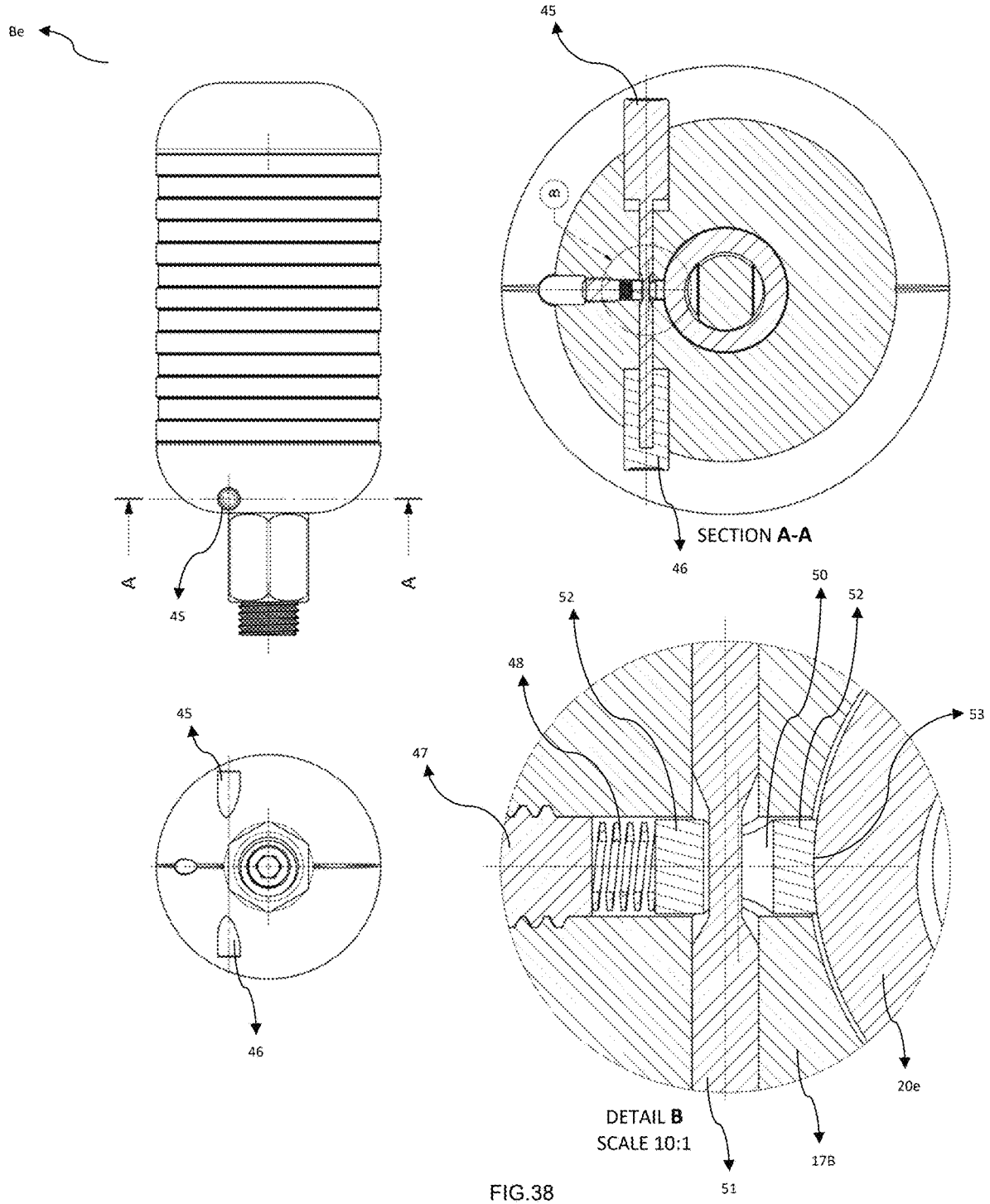
FIG. 38, is a technical drawing of a mechanical release solution for a mechanical brake in engaged position.
Figure 39:
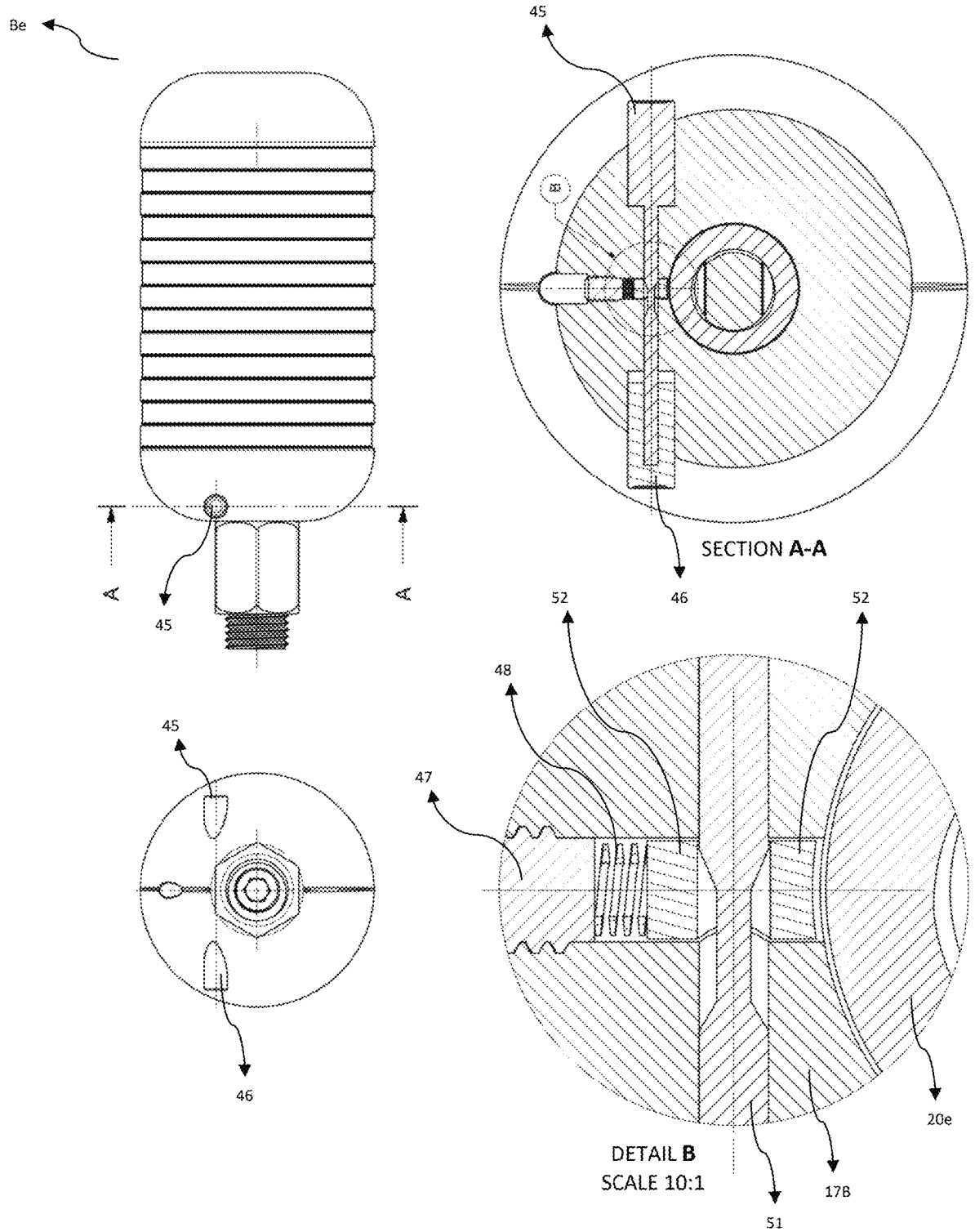
FIG. 39, is a technical drawing of a mechanical release solution for a mechanical brake in disengaged position.

FIG. 36 is a drawing displaying a suggested mechanism to release a spring plunger (a releasable ratchet mechanism). The ball 44 is replaced by a moving piston 49. Said piston 49 has an internal hole 50, is pushed toward the main nut 20 by a spring 48, which is backed by a threaded end cap 47. The release button 45 pushes a release needle 51 in the hole 50 of the plunger piston 49. The conic shape of the release needle 51 acts as a wedge and pushes back the plunger piston 49 away from the main nut 20. FIG. 37 shows the same mechanism in released position when the plunger piston 49 is pushed back and the main nut 20 can revolve freely without any resistance and noise. FIG. 38 shows embodiment Be. Embodiment Be is basically the same as embodiment Bd, only the plunger piston 49 is replaced by a braking piston 52. The contact surface 53 of the brake piston 52 is shaped to match the surface of the main nut 20*e* (which has no dents), and is made of a brake pad or a resistance generating material such as nylon (an elastic threadlocker). FIG. 39 shows embodiment Be In released configuration, when the release needle 51 is pushed into the hole of brake piston 51, and the brake piston 51 is pushed away from the main nut 20*e*. While both releasing and engaging is done manually, putting a spring under release button 45 may do the re-engagement automatic, meaning releasing the button 45 will re-engage the spring plunger.

Various designs may be considered for the weights. Instead of 2 male guide pins, each weight may have only one pin at one side and a hole at the other side to receive a pin from another weight. This configuration may allow all the weights to be stacked on each other in the same direction which may seem more visually pleasant to some users. However, this configuration has the disadvantage of inferior weight distribution since all the sliding tracks are placed at one side. Also the user should be careful about the upper side or the lower side of the weight since the weight will not be perfectly symmetric in relation to XY plane anymore. Furthermore, a user may still put a guiding pin inside the track 28 of the other weight which may cause confusion. Thus in case of adopting such solution, the size of the guiding pin should be bigger than the size of the track 28.

An important point regarding the design of the Nut 20 is it's hexagonal shape. While it allows good grip to rotate it by hand, it allows using a wrench when for whatever reason (e.g. over tightening) the nut is stuck, the user can use a standard wrench in order to release it. While the bigger diameter of the fixed jaw 17 and the weights allow to grip them by hand, a vice may be required if the nut is badly stuck. As an alternative, an additional hole may be devised on the fixed jaw to put a rod, a screw driver, or an Allen wrench inside the hole and keep it immobile while using the wrench on the nut 20. Similar solution (having a hole) may be used for the weights of embodiment A, machining a hole on the perimeter surface of the weights 2 for example, allows to put a screw driver in the hole and release a stuck weight 2.

Figure 40:
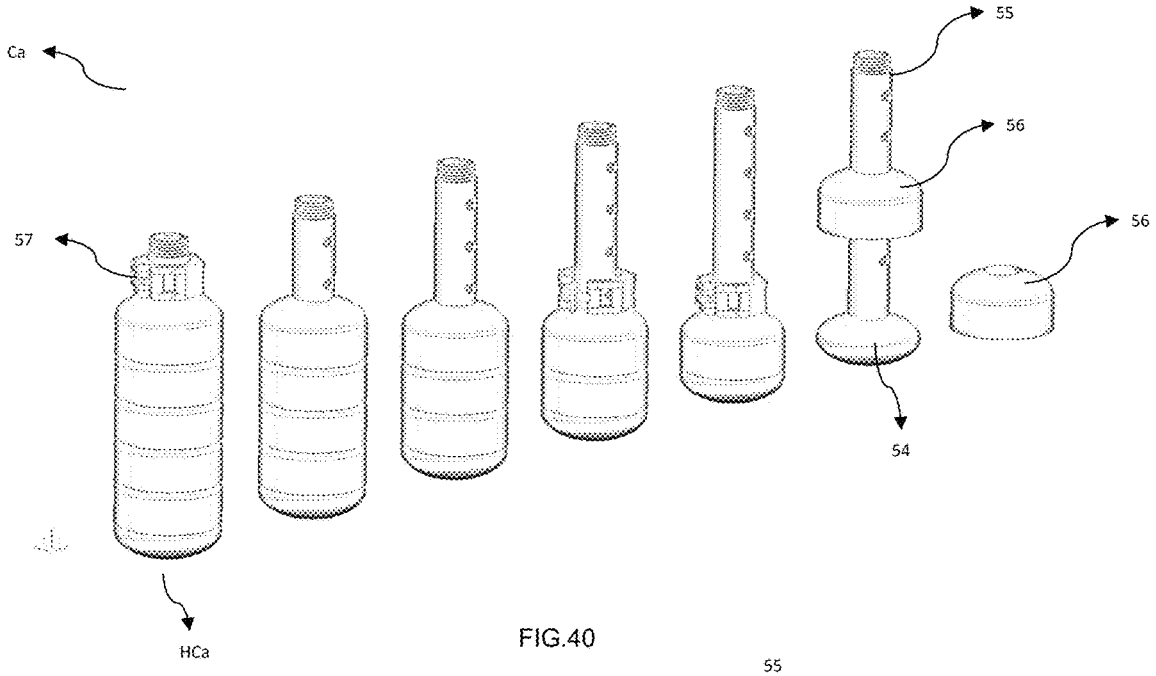
FIG. 40, illustrates different configurations of embodiment Ca of the present invention.

FIG. 40 displays embodiment Ca. Embodiment Ca includes a fixed weight 54 which is connected to a weight carrying shaft 55. The weights 56 are being slid on the weight carrying shaft 55. A special grip 57 is suggested to keep the weights in place. The displayed fixed weight 54 has an ovoid shape, and the weights have a bowl shaped body which is concave at one end and convex at the other end to create a cylindrical shape when mounted on the fixed weight 54. However, while all the weights of the present invention are shown in cylindrical form, it should be readily understood that the weights of all the embodiments of the present invention may have ovoid, cylindrical, hexagonal, etc. shapes and the shape of the weights does not limit this invention.

Figure 41:
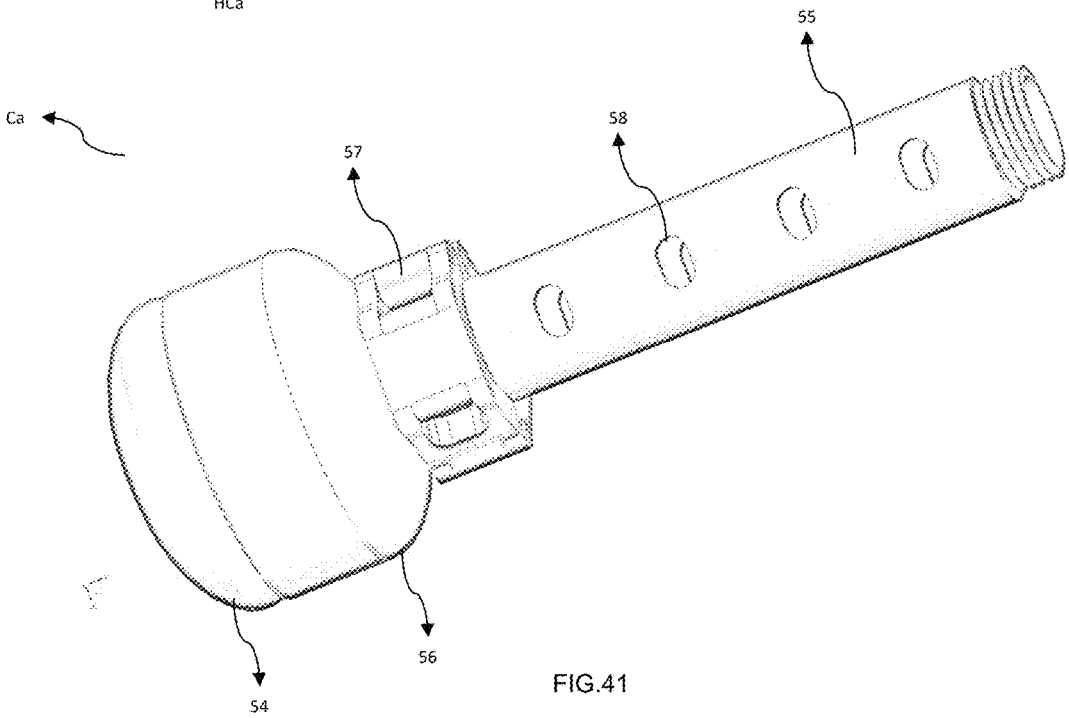
FIG. 41, illustrates embodiment Ca of the present invention with one weight.
Figure 42:
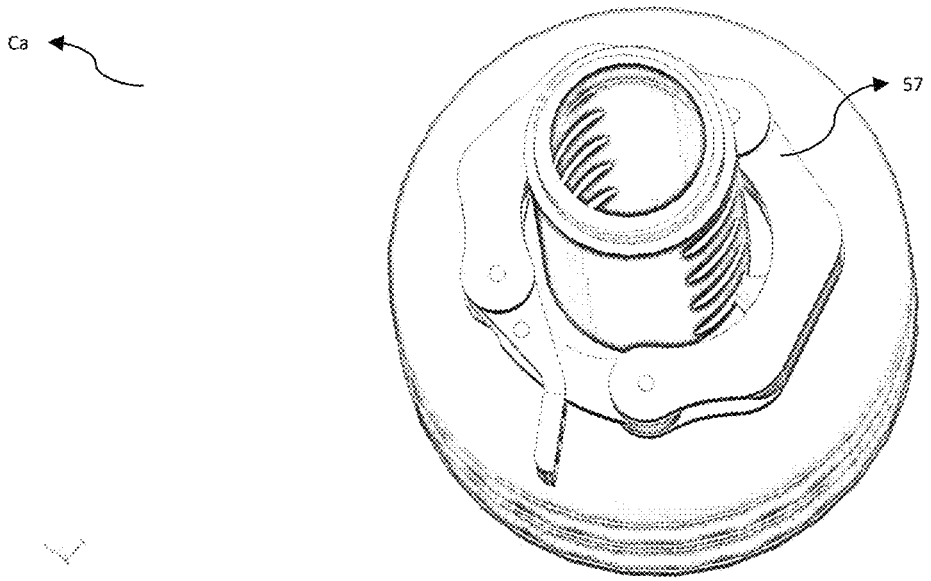
FIG. 42, illustrates embodiment Ca of the present invention with one weight and unlocked grip.
Figure 43:
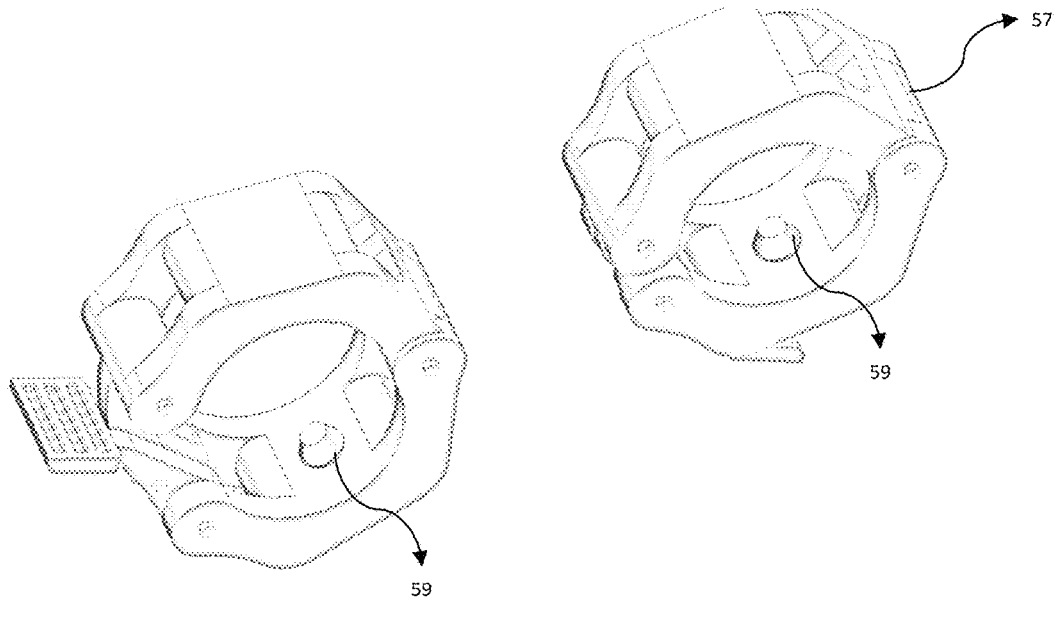
FIG. 43, shows the grip of embodiment Ca of the present invention from two angles.
Figure 44:
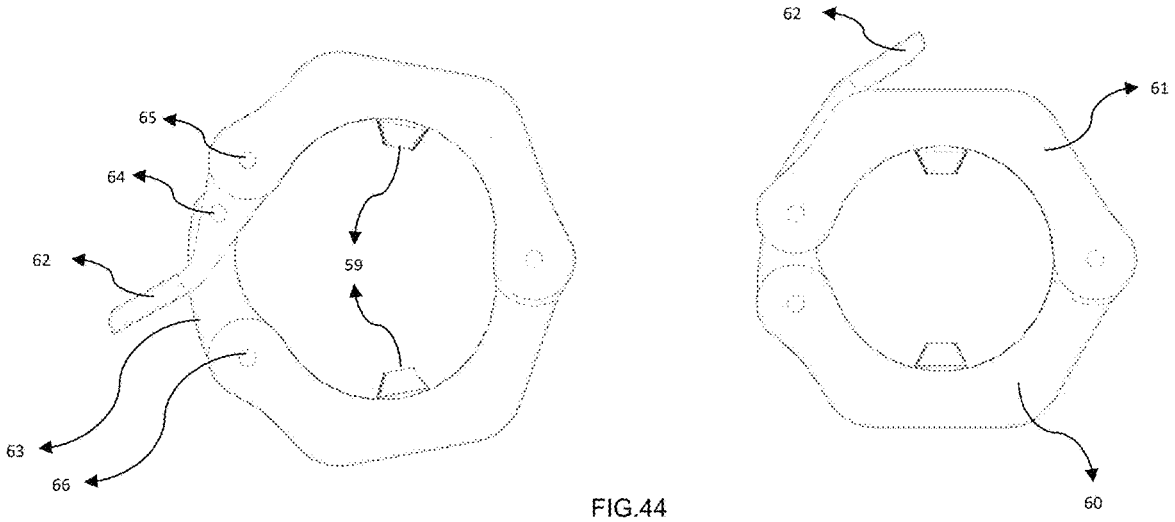
FIG. 44, shows the grip of embodiment Ca of the present invention in locked and unlocked positions.

FIG. 41 displays the mace head for embodiment Ca with one weight 56, and a grip 57 assembled on the weight carrying shaft 55. The weight carrying shaft is character by having oval shaped holes 58 to be engaged with said special grip 57. FIG. 42 displays said grip 57 in open position, and FIG. 43 is a perspective view of said grip 57 from 2 different angles. While this grip 57 seems similar to a standard collars, it is specially characterized by having 2 short pins 59 those engage with oval shaped holes 58. As displayed in FIG. 44 said grip 57 is similar to every conventional barbell collar and has to halves 60 and 61, a small handle 62, and an intermediate linkage 63. Describing a market available mechanism is not a part of this document. However, once closed, the pin 64, passes the line connecting centerlines of pins 65 and 66, and as a result the mechanism becomes a self-locking mechanism and will never open by itself, unless being opened by the handle 62. The length of the pins 59 is chosen so that the grip 57 can never be locked unless the pins are in the oval holes 58. The tips of the pins 59 have conic shape while the base of the pins has a very short cylindrical shape. The first purpose of the conic tips is to facilitate inserting the pins in the holes. But the second and more important purpose of the conic pins is that the pins can be inserted in the holes when the grip is 1-2 mm higher than it's position and the weights. When being closed, the conic pin acts as a wedge inside the holes and pushes the grip down which as a result pushes the weights 56 down and keeps the weights under pressure in order to avoid vibrations during workout.

Figure 45:
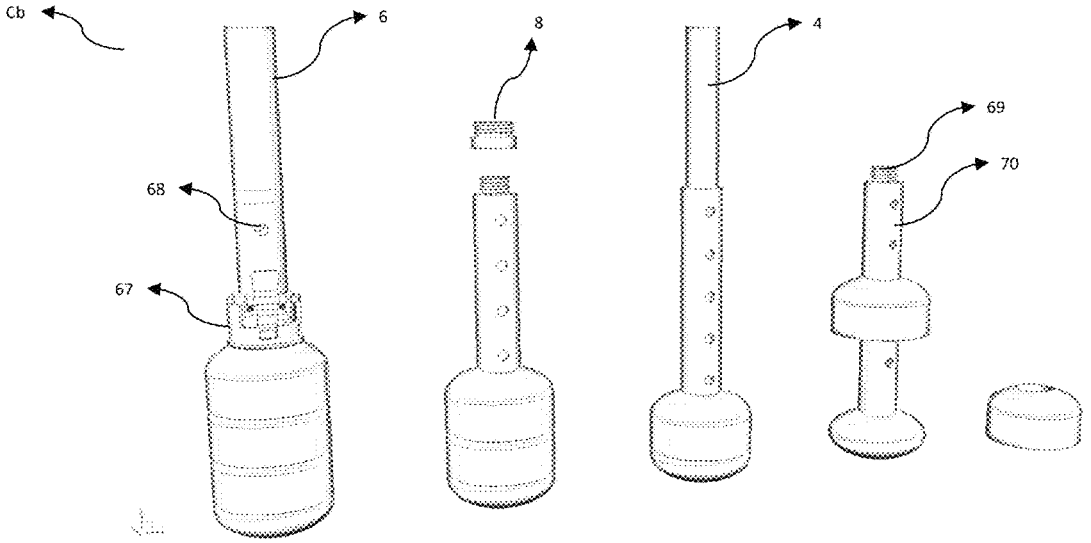
FIG. 45, illustrates 4 different configurations of embodiment Cb of the present invention.

FIG. 45 displays embodiment Cb. It has the same basics of embodiment Ca with a different grip 67, and cylindrical holes 68 instead of the oval ones 58. The main differentiating points of the embodiments Ca and Cb of the present invention with patent number US20170095687A1 are using pins for securing the grip which eliminates the risk of dropping weights on the users hands when the mace is used upside down, and the possibility of having a handle section 4 flush with the weight carrying shafts 55 and 70. However, since it is common to use a smaller handle 4 for lower weights specially for women or users with smaller hands, the modular design demands having the possibility of connecting different handle sizes. In case of the illustrated embodiment Cb includes a small thread 69 which allows connection of the modular handle system as demonstrated for embodiments A and B including handle sections 4, adapter 8, and bigger handle sections 6 as can be seen in FIG. 45.

Figure 46:
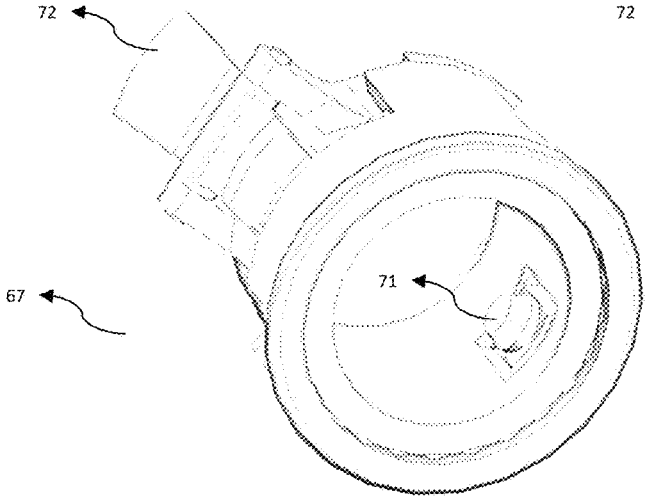
FIG. 46, shows the grip for embodiment Cb of the present condition in "locked" position.
Figure 47:
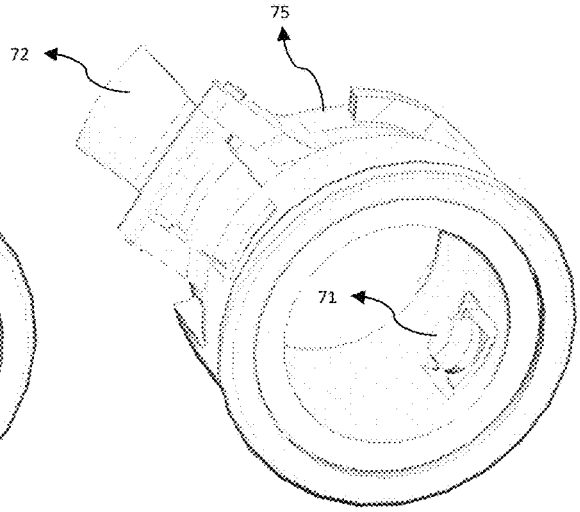
FIG. 47, shows the grip for embodiment Cb of the present condition in "engaged" position.
Figure 48:
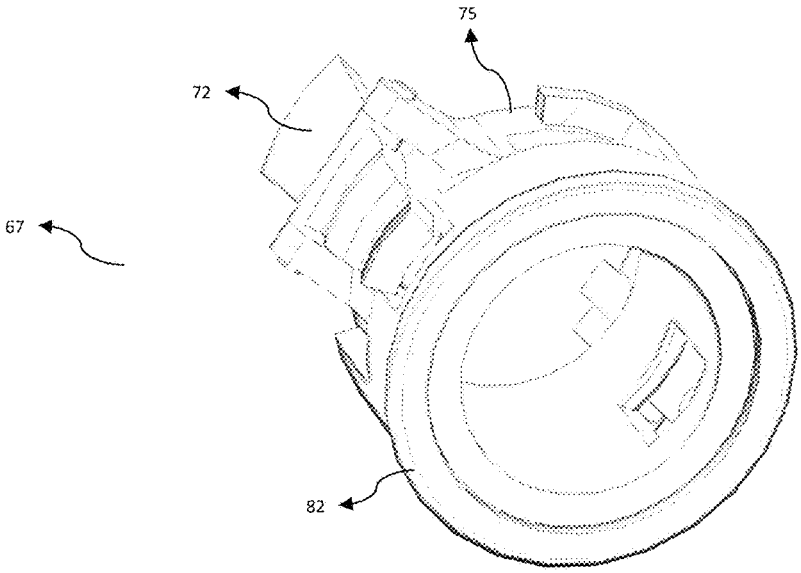
FIG. 48, shows the grip for embodiment Cb of the present condition in "open" position.
Figure 49:
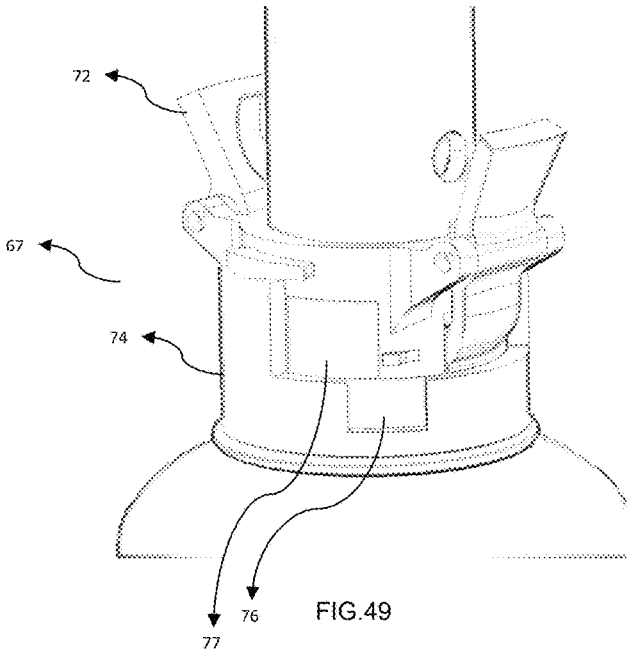
FIG. 49, shows the grip for embodiment Cb of the present condition in "locked" position.
Figure 50:
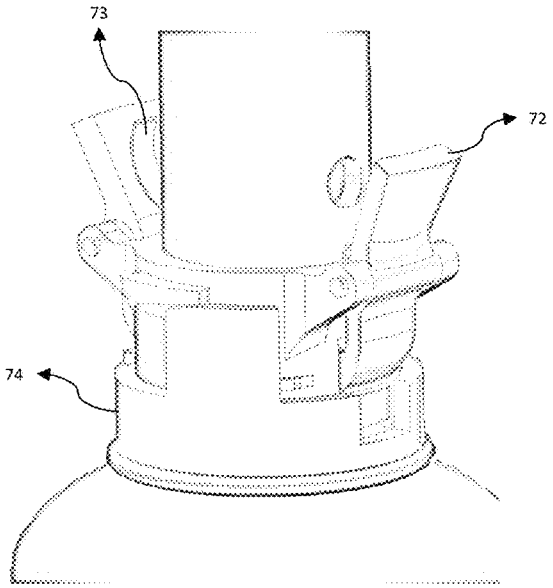
FIG. 50, shows the grip for embodiment Cb of the present condition in "engaged" position.
Figure 51:
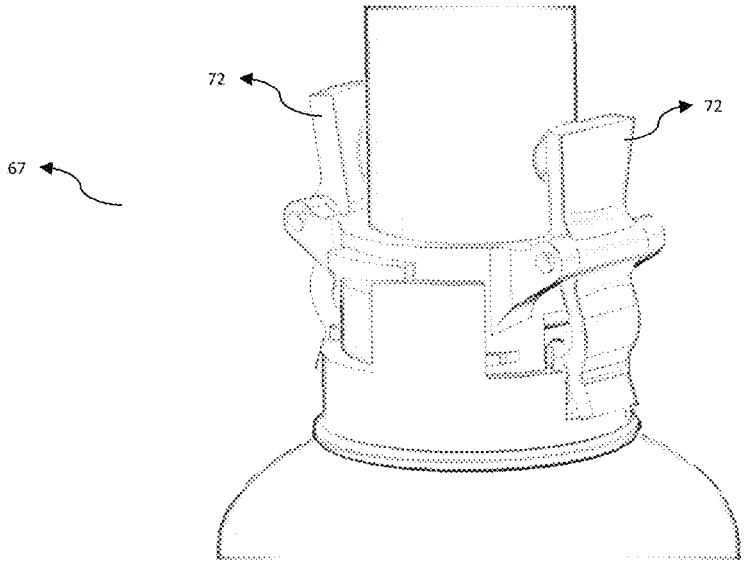
FIG. 51, shows the grip for embodiment Cb of the present condition in "open" position.

FIG. 46 to FIG. 47 display the function of grip 67. The grip type 67 has 2 short pins 71 those get engaged with the holes 68. The grip 67 has 3 working positions: "Open", "engaged", and "locked". The grip is open when the engaging pins 71 are out of the way as a result of the handles 72 being pushed toward each other as displayed in FIG. 48. In case of the engaged and locked positions the pins are inside the main hole of the main body 75 as displayed in FIG. 46 and FIG. 47. FIG. 51 shows the open position of the grip 67. The pins are pulled out by pushing the two handles 72. FIG. 50 shows the "engaged" position when the pins are engaged inside the holes 68. The handles 72 are pushed in "engaged" position by the means of handle springs 73. The handle springs are schematic and are illustrated so that to be visible and do not represent the mass production solution. FIG. 49 shows the locked position. There is a sleeve 74 around the man body of the grip 75. The sleeve 74 is rotated for ⅛ of a turn, and covers the tips of the handles 72. Thus the handles are locked in their position and cannot move. As a result the pins 71 remain engaged with the holes 68 and the grip cannot be disengaged by workout forces. The same figure shows 2 signs 76 and 77. These signs are placed to show that the grip is secured and locked. Signs 76 and 77 may preferably have green color and may include an OK or a tick sign on them. As can be compared with FIG. 50, the OK/Green signs, are only visible when the sleeve 74 is in locked position. Since the grip 67 has two handles, another set of signs 76 and 77 is positioned on the back of the grip which is not visible in the figures.

Figure 52:
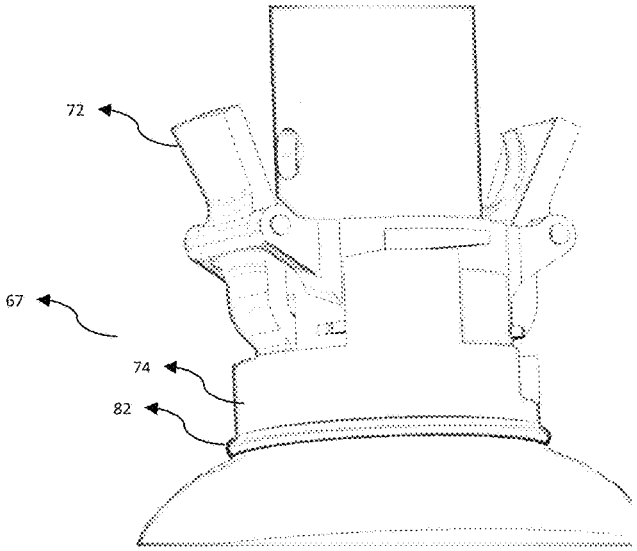
FIG. 52, shows the grip for embodiment Cb of the present condition in "locked" position.
Figure 53:
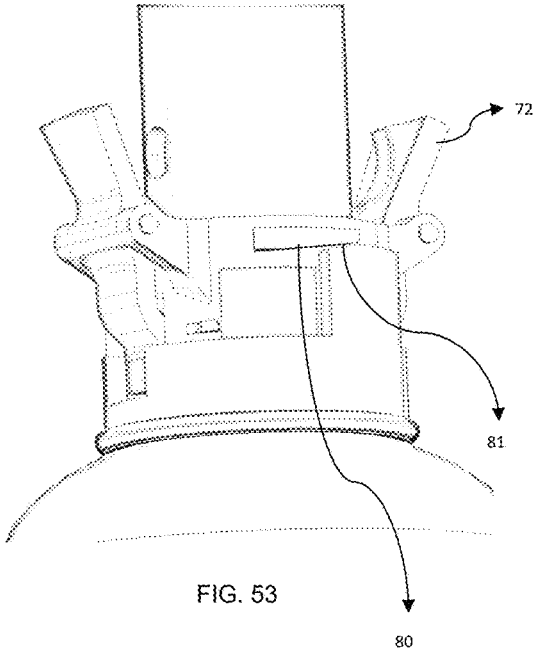
FIG. 53, shows the grip for embodiment Cb of the present condition in "engaged" position.
Figure 54:
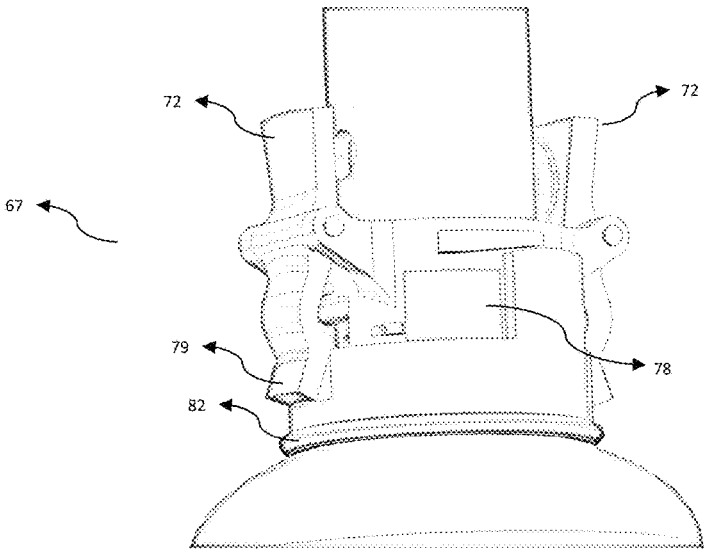
FIG. 54, shows the grip for embodiment Cb of the present condition in "open" position.
Figure 55:
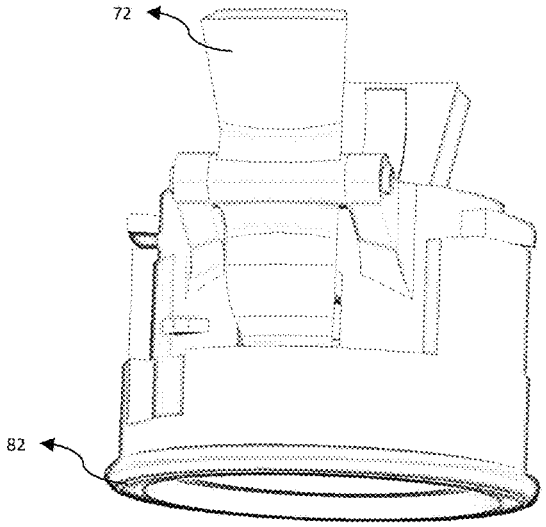
FIG. 55, shows the grip for embodiment Cb of the present condition in "locked" position.
Figure 56:
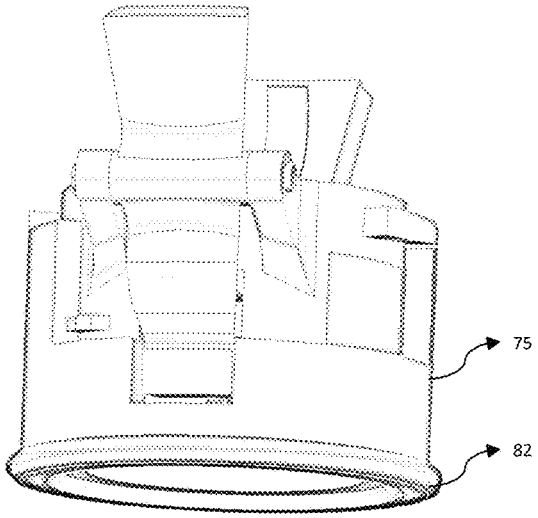
FIG. 56, shows the grip for embodiment Cb of the present condition in "engaged" position.
Figure 57:
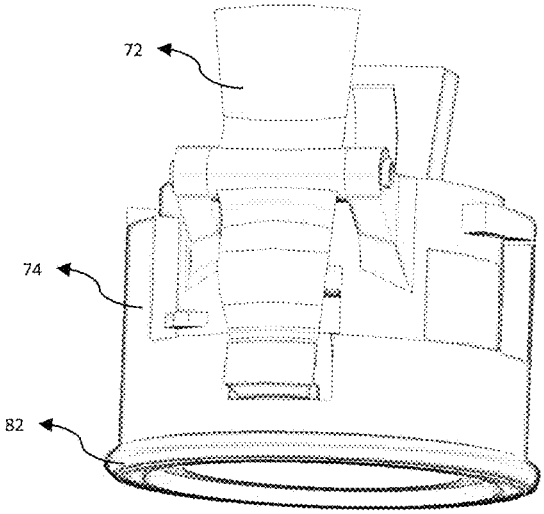
FIG. 57, shows the grip for embodiment Cb of the present condition in "open" position.

FIG. 54 shows the grip 67 in open position. A visual sign 78 is on the external surface of the main body 75. Another visual sign 79 is displayed on the outer surface of the lower tip of the handle 72. These signs are visible in both "open" (FIG. 54) and "engaged" (FIG. 53) positions and show that the device is not secured for workout. The signs 78 and 79 may be in red color and may include a not OK or caution or an "X" sign. When the sleeve 74 is rotated to "locked position", as displayed in FIG. 52, both signs 78 and 79 are covered and not visible. Since the grip 67 has 2 release handles, another set of signs 78 and 79 is positioned on the back of the grip which is not visible in the figures. FIG. 53 shows a chamfered ledge 80 on the main body 75. There is another chamfered edge 81 on the outer sleeve 74. Both chamfered edges 80 and 81 come into contact during rotation of the outer sleeve 74 for conversion from engaged position to locked position. The chamfered edges act as wedges and push the sleeve 74 down toward the weights and put some pressure on them which is necessary to avoid vibrations during workout. It should be added that the sleeve 74 has the freedom to axially move about 2-3 millimeters on the main body 75. This mechanism allows the grip to have an acceptable clearance from the weights when being engaged. It allows the pins 71 to be easily engaged under no pressure. There may be a slightly compressible lip 82 (e.g. made of rubber) on the lower edge of the outer sleeve 75. All the 3 working positions are again shown in FIG. 56 to FIG. 58.

Figure 58:
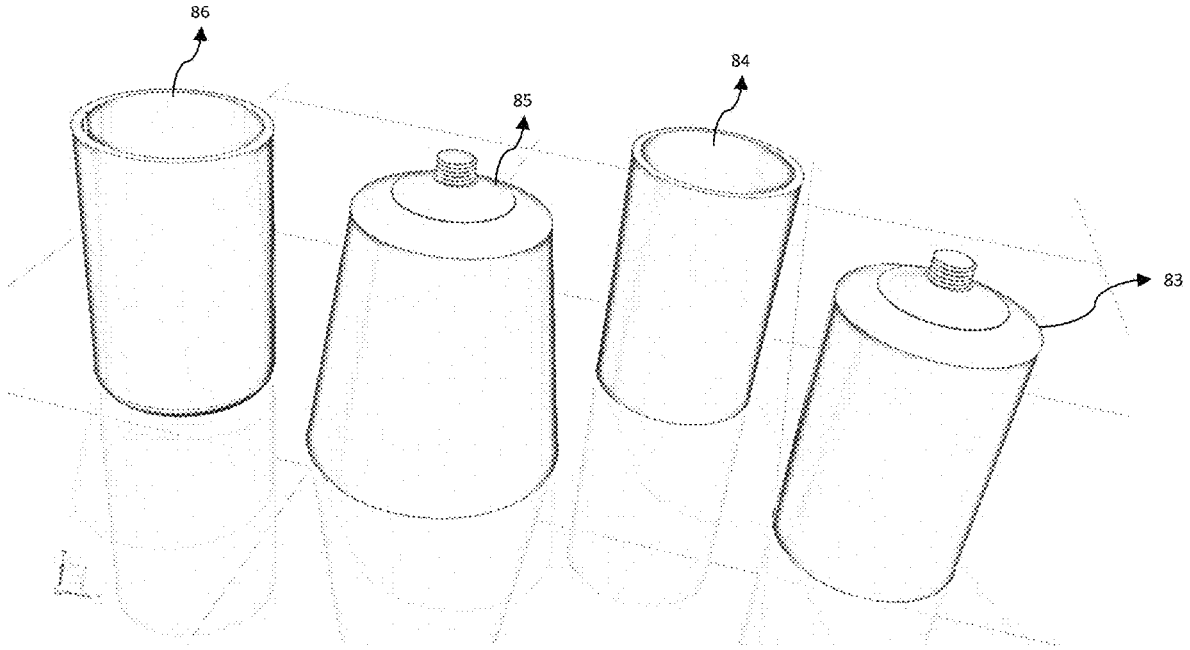
FIG. 58, illustrates 4 different covers for the mace head of different embodiments of the present invention.
Figure 59:
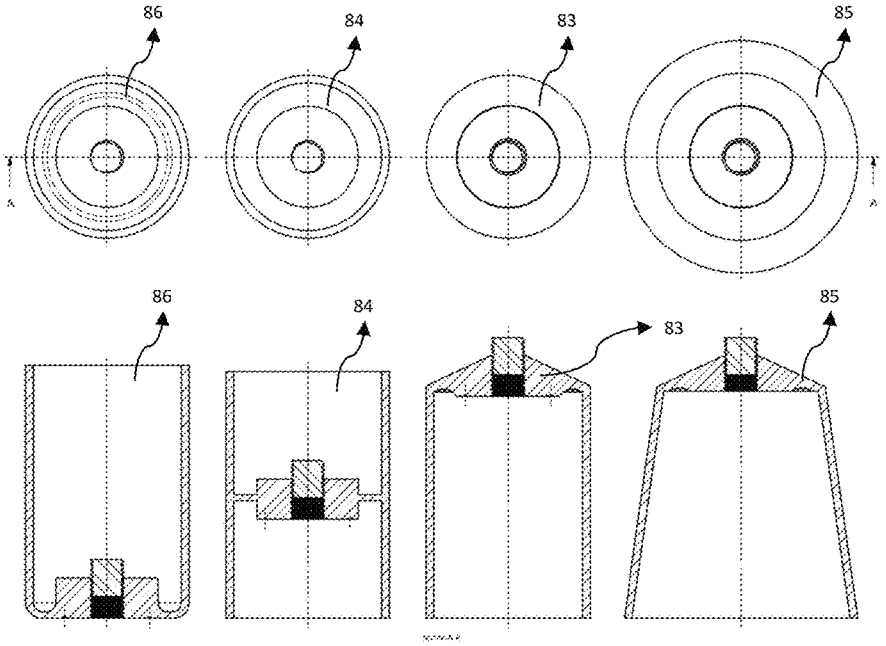
FIG. 59, illustrates 4 different covers for the mace head of different embodiments of the present invention.
Figure 60:
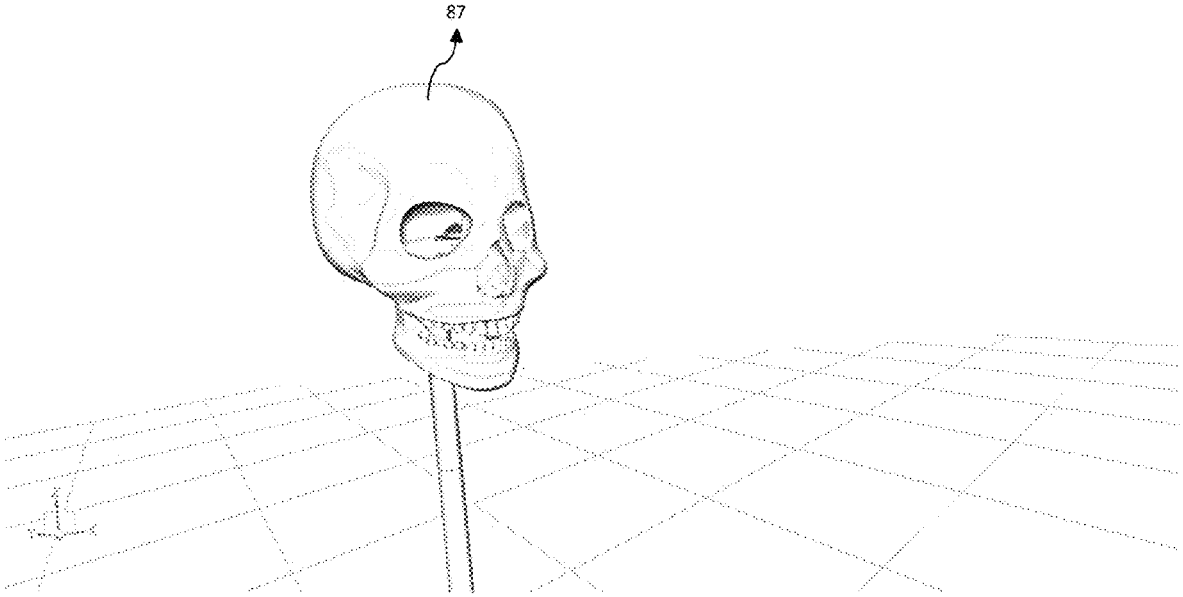
FIG. 60, illustrates a cover for the mace head of embodiment A of the present invention.
Figure 61:
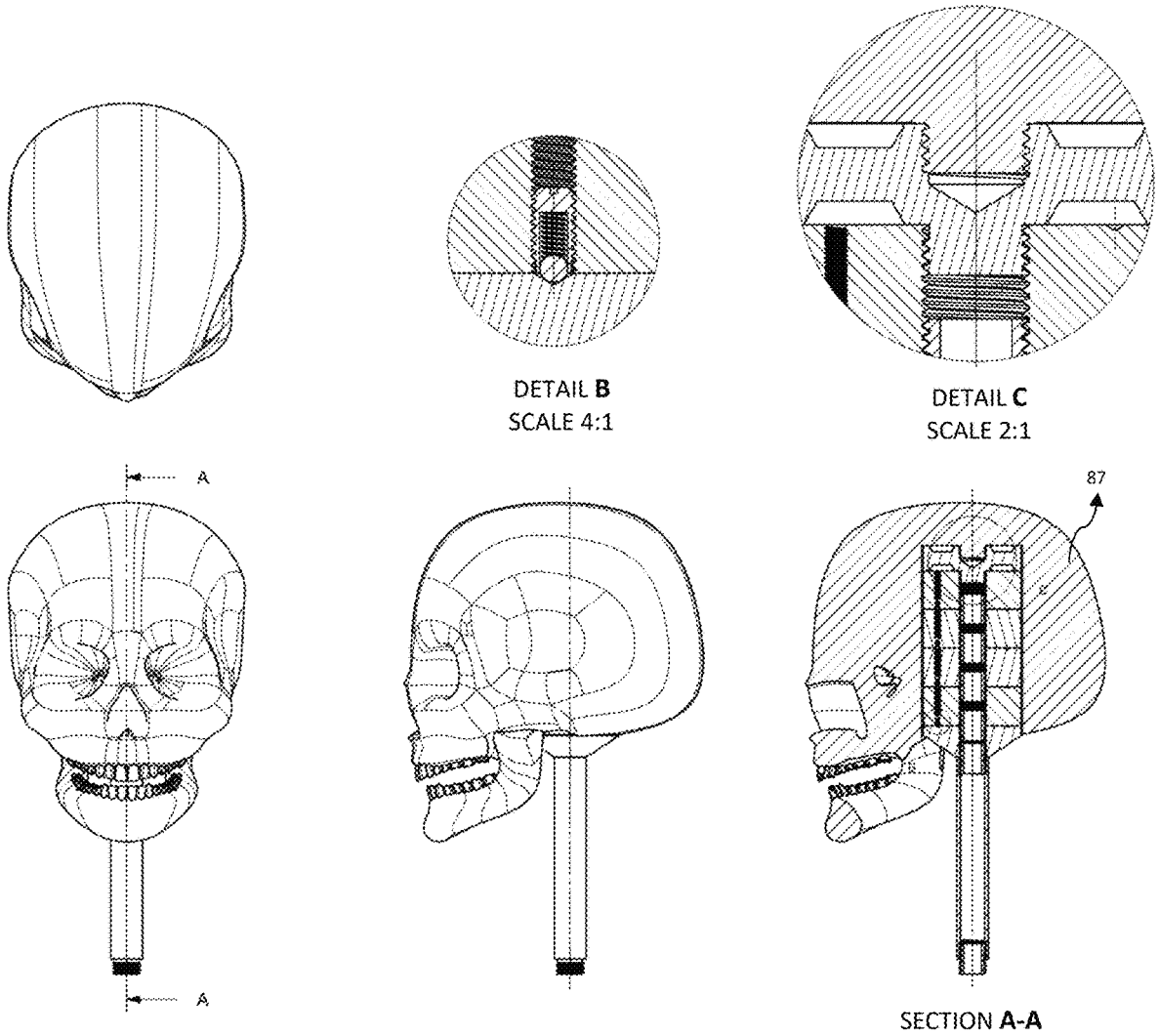
FIG. 61, is a technical drawing of a cover for the mace head of embodiment A of the present invention.

FIG. 58 and FIG. 59 show a few possible covers for the mace head. The covers may have various purposes. A steel/aluminum made mace head may be dangerous if hits the body of a beginner user. Then a mace head cover, if being made of a flexible and impact absorbing material such has rubber, may effectively act as a guard for the user. It may be essential for workout in crowded GYMs. Mace head covers may also have cosmetic reasons. They follow the modular design basics of the handles, having a male thread at one side of the connection flange and a female thread at the other side. Mace head covers 83 and 85 may effectively be connected between the handle assembly and the mace head. For example a handle section 4 may be connected to the male side of the connection flange, while a weight 2, or a mace head H.A or H.B may be connected to the female side. Mace head cover 86 may be used as the last weight for embodiment A. A decorative version of this type is also shown in FIG. 60 and FIG. 61. It may also been used for embodiment C but needs a female connection at the end of the handle. Mace head cover 84 is more suitable for embodiment A and allows connection of weights at both ends of the connection flange.

FIG. 60 and FIG. 61 illustrate a mace head cover 87 in the form of a skull. It's a modified version of mace head 86. It may be made out of an impact absorbing material such as polyurethane foam. For more advanced users it may be made of materials such as wood, plastic, etc.

Figure 62:
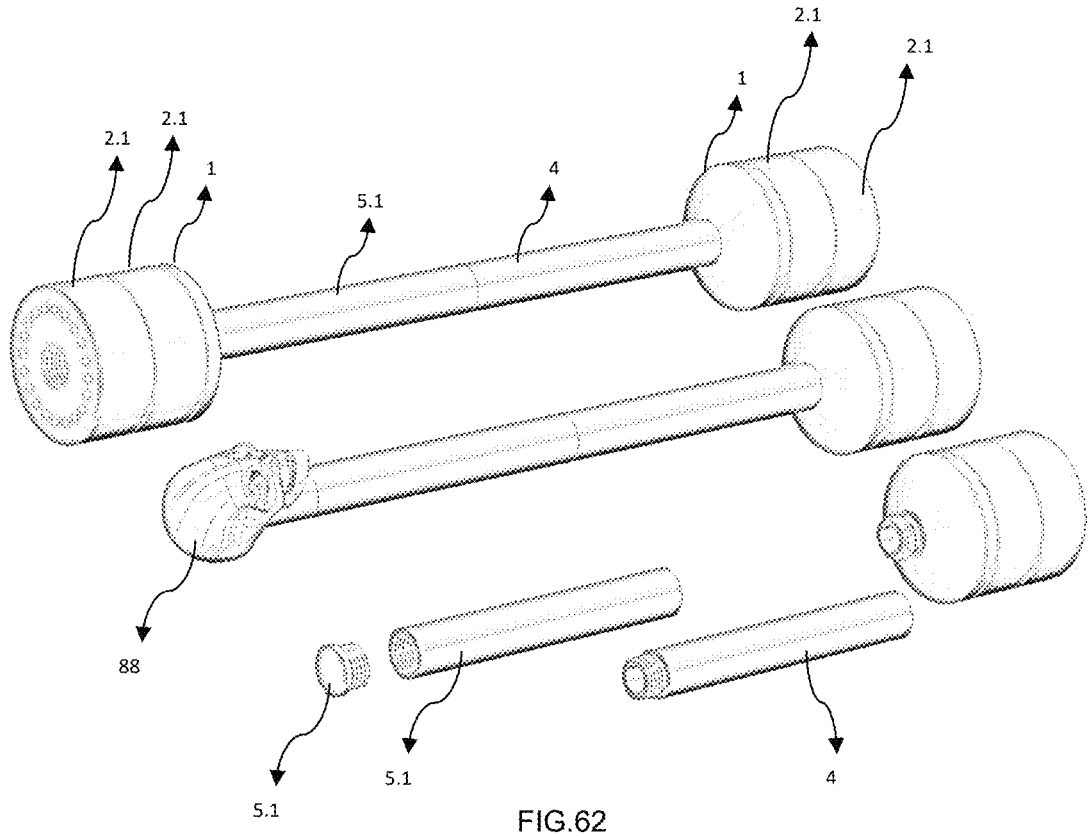
FIG. 62, shows different possible configurations for the handles of the present invention.

FIG. 62 illustrates some possibilities of the modular handle design. The handle sections 4 as said before have a male thread at one end and a female thread at the other end. However, the handle end section 5 may include a handle section with 2 female ends 5.1 and an end cover 5.2. The end cover 5.2 has a male thread in case of the illustrated embodiments. Instead, an end cover may have a female thread and the last section body 5.1 may be replaced by a standard handle section 4. The end cover may be replaced by a decorative part. For example the skull shaped end cover 88 is a decorative end cover. Using a handle section with 2 female ends 5.1 allows the possibility to add weights to the other end of the section and simulate workout with dumbbells and barbells.

Figure 63:
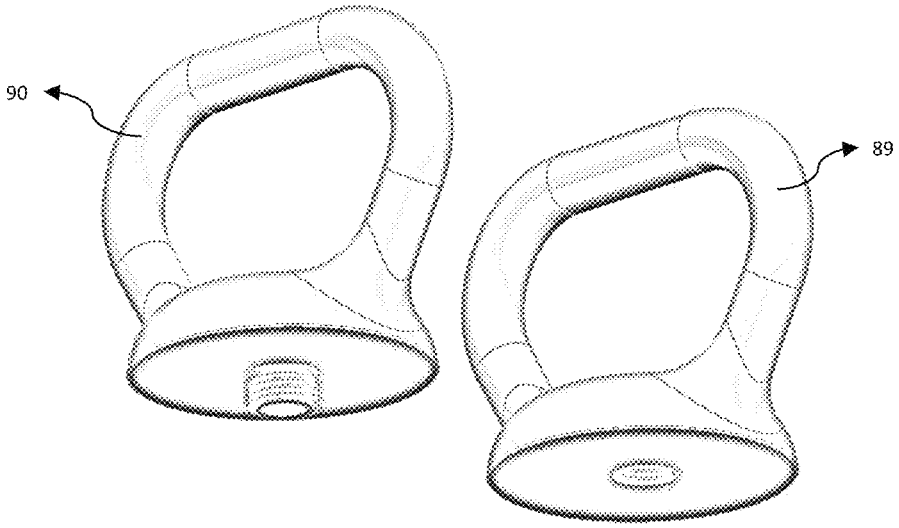
FIG. 63, illustrates kettelbell handle option for the present invention.
Figure 64:
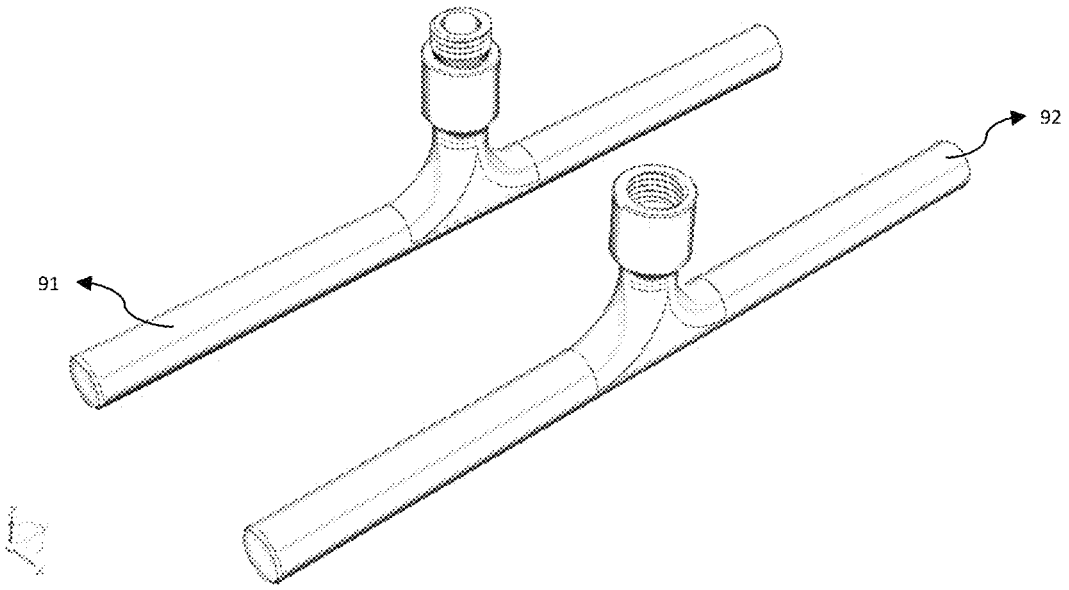
FIG. 64, illustrates curl bar handle option for the present invention.
Figure 65:
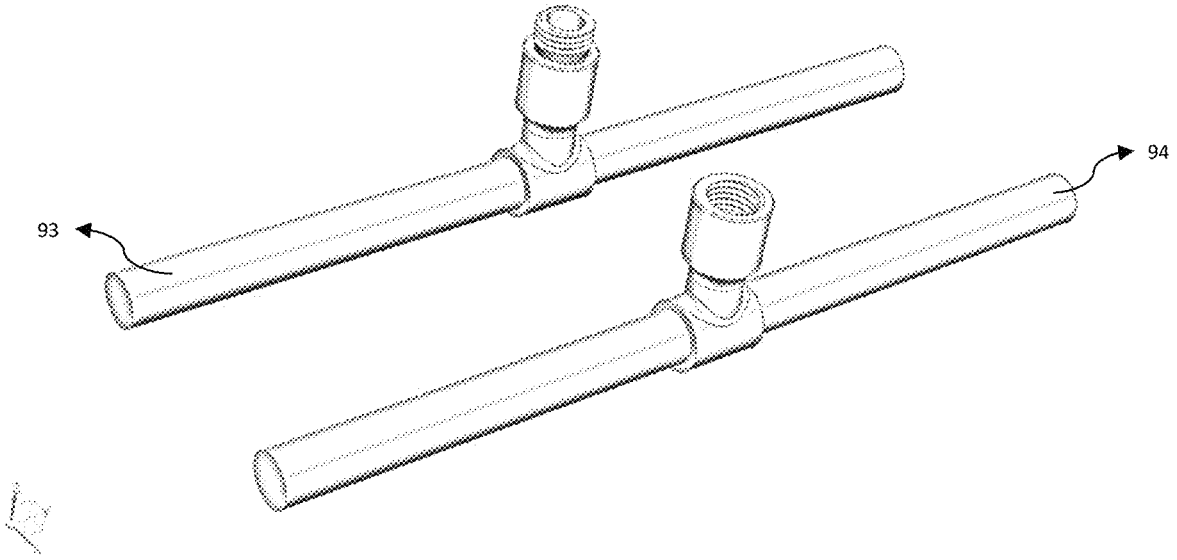
FIG. 65, illustrates rotating curl bar handle option for the present invention.
Figure 66:
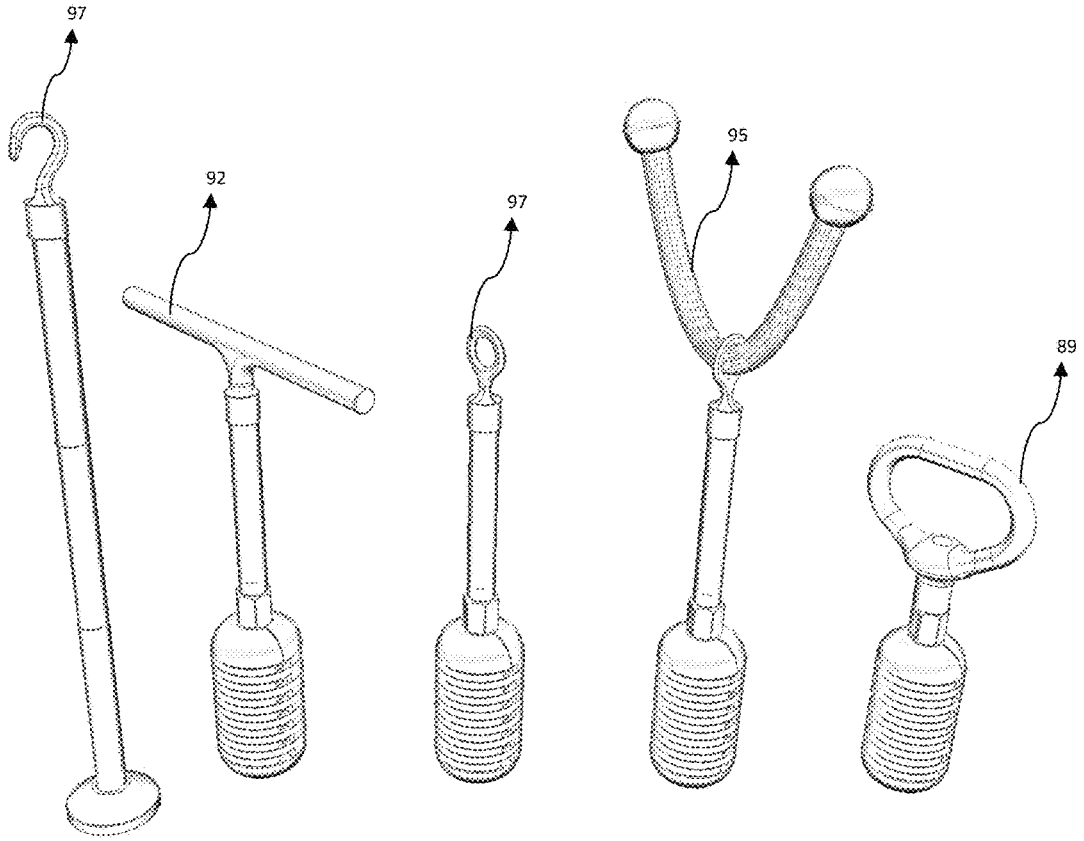
FIG. 66, illustrates 5 different accessories for the present invention.

The modular design of the handles allow connecting different ad-ons to the mace. FIG. 63 displays a kettlebell shaped handle 89 which can replace the modular handle of the mace. The same handle may be made with male thread 90 and be connected to the last weight of embodiment A, allowing the mace to have a standard handle at one end and a kettlebell handle at the other end. FIG. 64 displays a pair of curl bars with male threads 91 and female threads 92. FIG. 65 displays a pair of revolving curl bars with male threads 93 and female threads 94. FIG. 66 shows five different mace assemblies, including ones with a kettelbell handle 89, rope 95, curl handle 92, a hook add on 96, which may also be made in the form of a spring snap hook, and a ring add-on 97 which enables various possibilities, from hanging the mace, to fastening a resistant band and connection of a standard spring snap hook. Various other attachments may be connected to the mace handle either directly or by the means of one of above mentioned solutions for spring snap hook, including every type of GYM standard attachments and machines attachments such as but not limited to Lat bars, revolving lat bars, cable bars, single rope attachments, stirrup handles, multi exercise bars, Row handles, V-bars, D-handles, D-handle straps, EZ-Bar handle, Indian club handle, Head Harness, etc.

Figure 67:
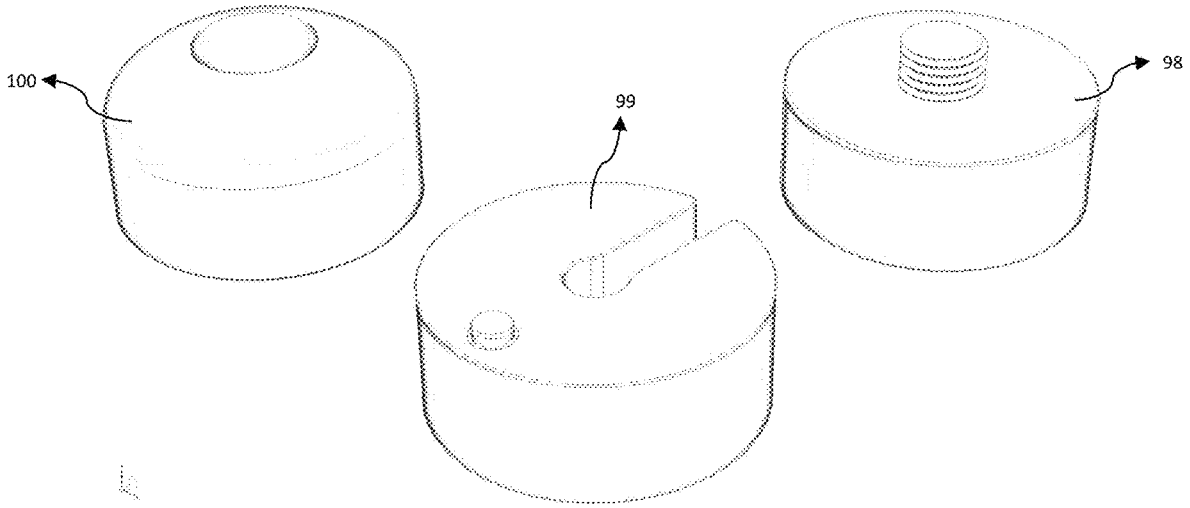
FIG. 67, illustrates 3 different shapes for optional ad-ons for the present invention.

The modular nature of the mace heads may not only be limited to adding different handles but also allow using different modules instead of weights. There may be various interesting modules to be used instead of standard weights. FIG. 67 shows 3 different shapes for add-on modules 98, 99, and 100. These modules may replace the weights on embodiment A, B and C. The at least one module is at least in part an object or device configured to include a weight, a vibrator, a sensor, a flashlight, a housing, a fillable housing, a speaker, a Bluetooth speaker, a memory storing device, a battery, processor, a display, or a decorative module. A suggested add-on module may be a vibrator module. A vibrator module may have a mechanical connection type similar to the weights, having a vibrator motor inside, at least one battery, and a power control unit. The power control may be limited to an on/off switch, or may have an electronic control unit and may have wireless connection means so that can be paired with a smartphone for controlling the vibration engine. Control of the vibration engine may include controlling the intensity or frequency of the vibration, or creating different vibration patterns. A smartphone controlled vibration system may be able to sync the vibration of the motor with the music played in the environment. While a mace is a very useful workout device for strengthening muscles, adding vibration helps strengthening smaller muscles and improving joint stability (e.g. for shoulders). Another module may be a light module, where the module may have at least 1 means of creating light, at least one battery and a control unit. A mace with a light module may be used to create many visual effects especially in the dark (e.g. for photography). Such module may have a control system which can be paired with a smartphone and be controlled by said smartphone in order to create light effects. Such light module may also be very helpful when the workout environment is very dark and may allow the user to see around during workout and help reduce the risk of collision with other people practicing in the same area. There may be modules that include at least one sensor. for example an acceleration sensor may count the repetitions, or recognize the type of workout. Such module if paired with a smartphone, may record the workout history. There may be fillable and inflatable modules those may be filled with a type of liquid or a granular material such as sand. Inflatable modules may be made of a flexible material that can be compressed when not in use. A fillable module acts like a solid module when fully filled. However, if filled partially, it may provide vibrations and unpredictable shocks resulted by fluid/sand movements which may add more variety to the workout. Said modules may replace the weights as mentioned before or be connected to any other place on the device since the modular design of the device creates many connection possibilities.

Figure 68:
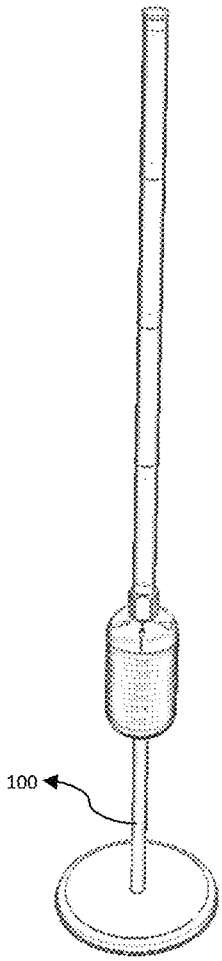
FIG. 68, shows a stand for the present invention.
Figure 69:
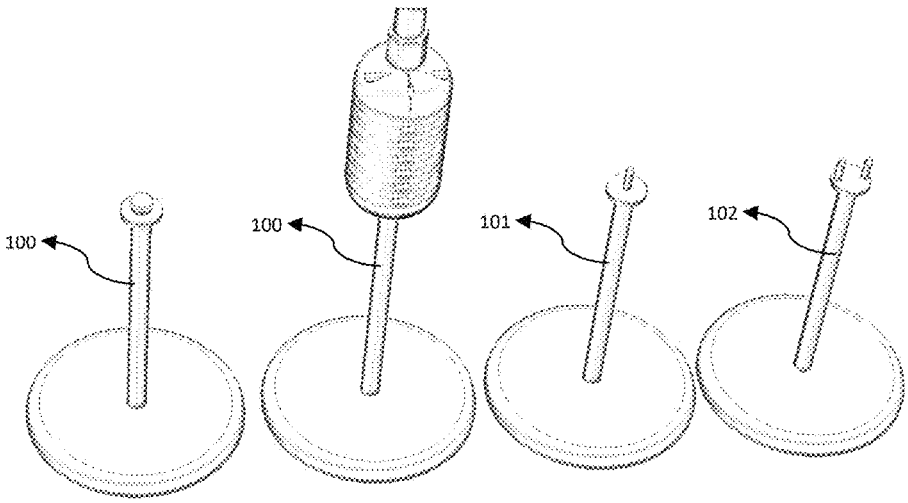
FIG. 69, shows 3 different stand designs for the present invention.
Figure 70:
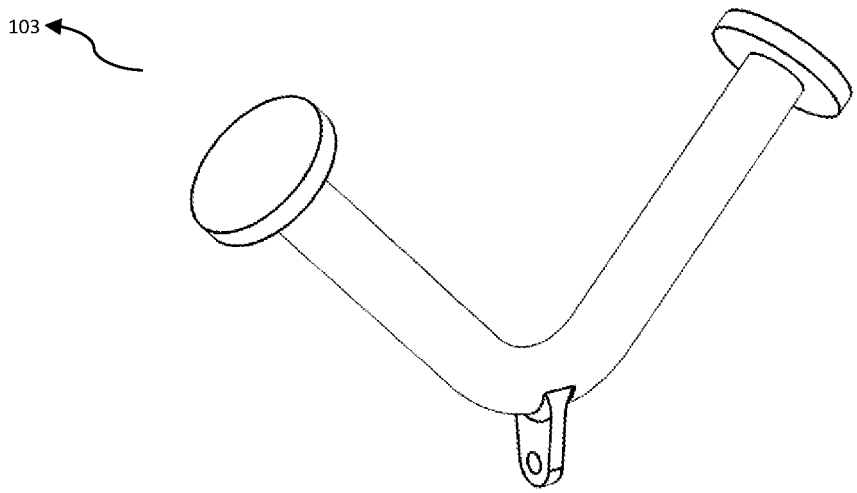
FIG. 70, displays a V-bar 103 also called a V-bar handle.
Figure 71:
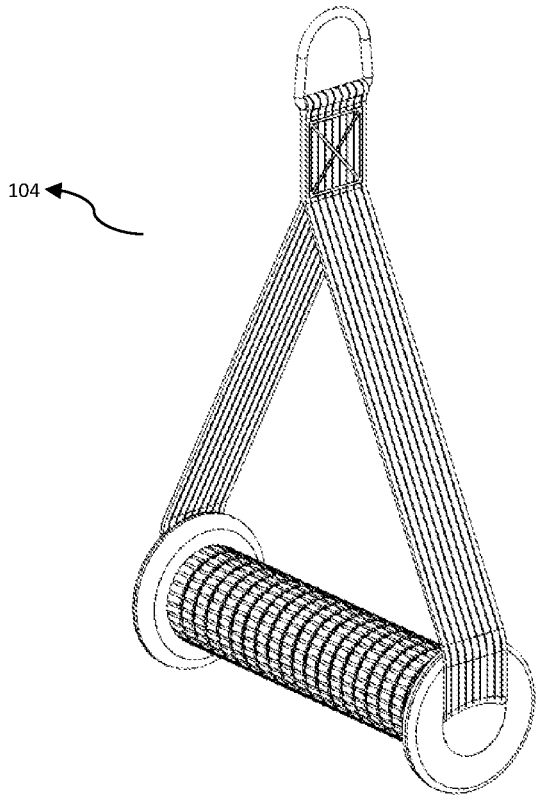
FIG. 71, illustrates a stirrup handle 104 also called a D-handle straps 104.
Figure 72:
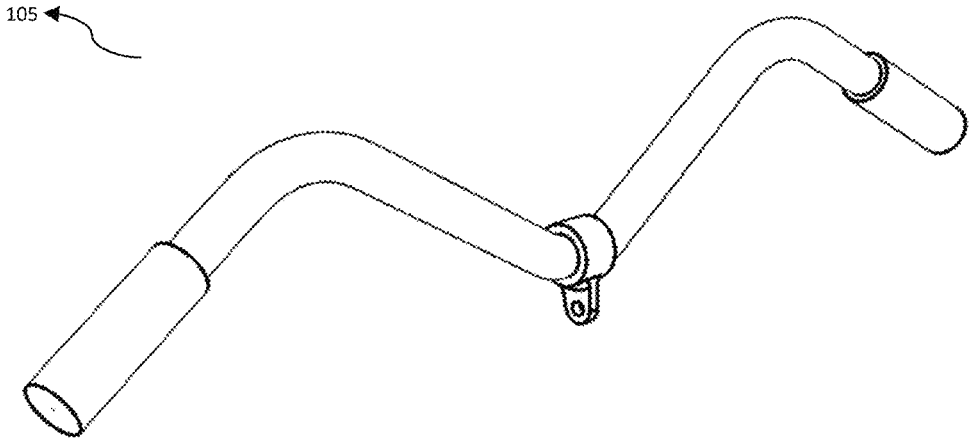
FIG. 72, shows an EZ-bar handle 105.
Figure 73:
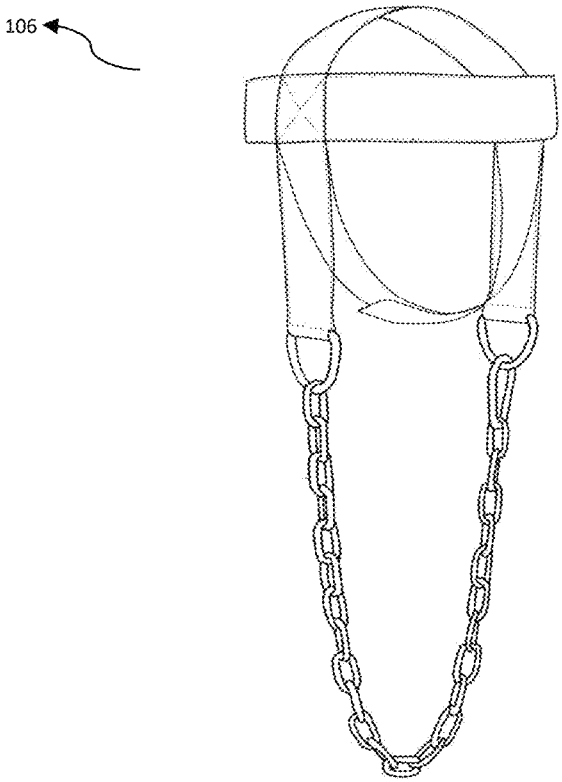
FIG. 73, shows a head harness 106.
Figure 74:
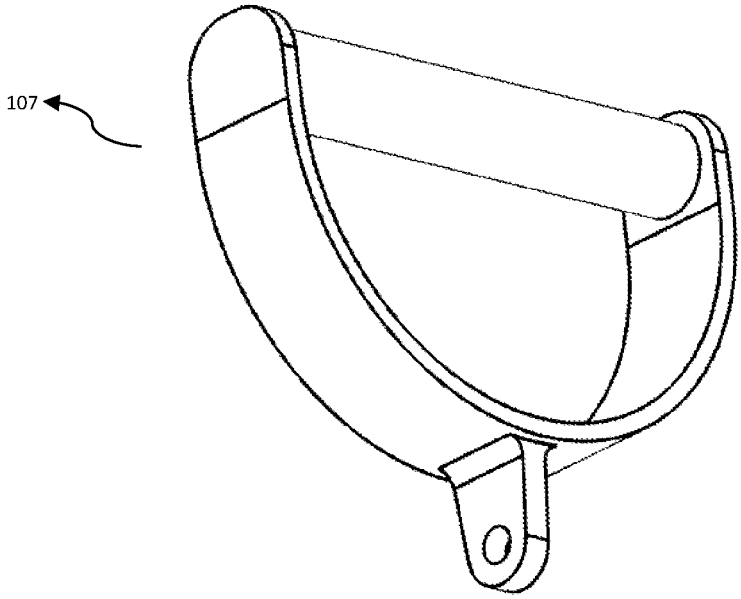
FIG. 74, shows a D-handle 107.
Figure 75:
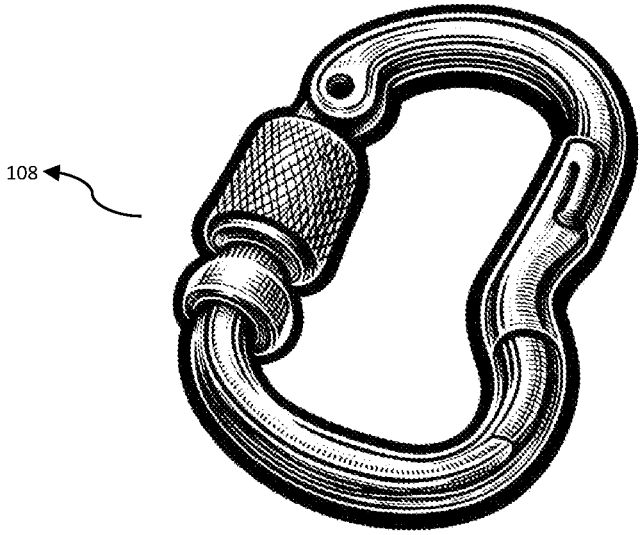
FIG. 75, displays a spring snap hook 108.
Figure 76:
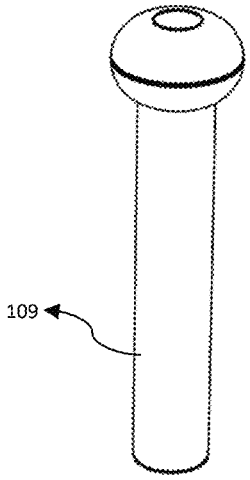
FIG. 76. shows a Persian Meel handle 109 also may be called an Indian club handle 109.
Figure 77:
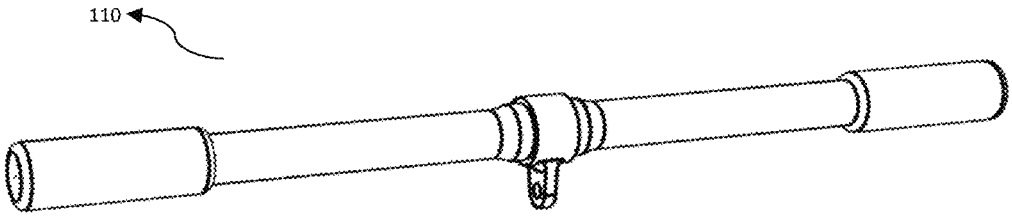
FIG. 77, shows a Cable bar 110.
Figure 78:
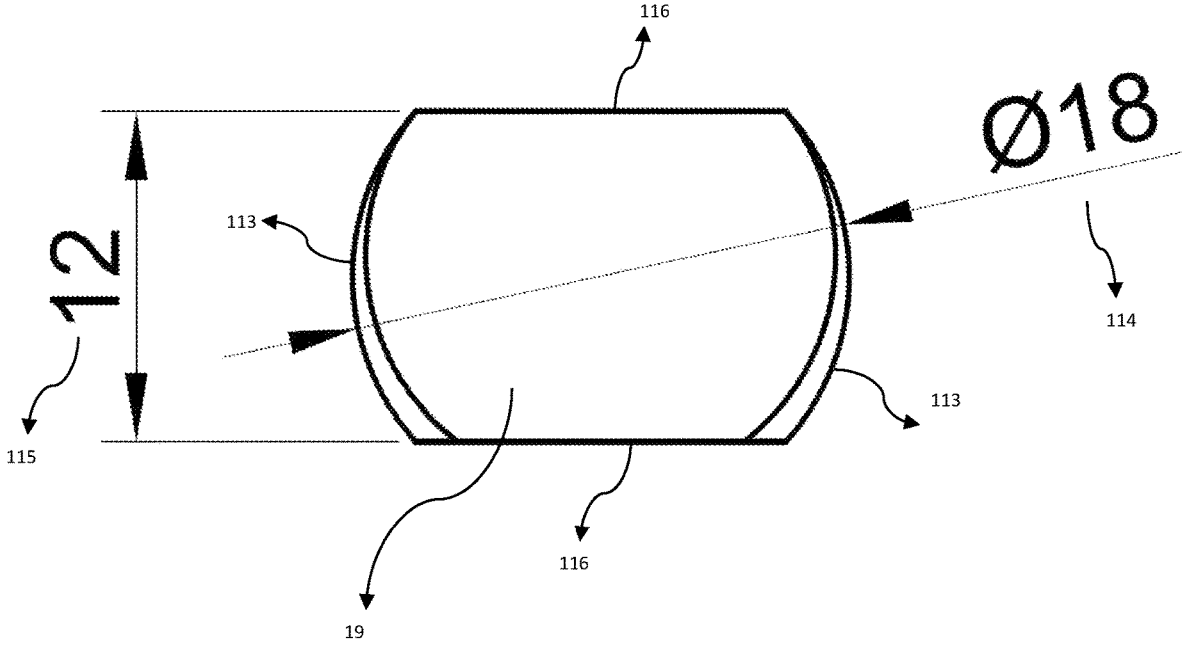
FIG. 78, displays a top view of threaded rod 19.

FIG. 68 shows a mace on a stand, while FIG. 69 shows different stand designs. Stand 100 has a threaded connection, Stand 101 has a pin and stand 102 has 2 pins. The bottom of the mace should be designed and made accordingly to adopt with the stand. A stand can maintain the mace in an upright and stable position when not in use.

FIGS. 70~77 display a few different standard handles, accessories or workout devices those can be attached to the present invention. The list includes FIG. 70 a V-bar 103 also called a V-bar handle, FIG. 71 a stirrup handle 104 also called a D-handle straps 104, FIG. 72 an EZ-bar handle 105, FIG. 73 a head harness 106, FIG. 74 a D-handle 107, FIG. 75 a spring snap hook 108, FIG. 76 a Persian Meel handle 109 also may be called an Indian club handle 109 since a Persian Meel and an Indian Club are basically the same workout device but in 2 different regions, FIG. 77 a Cable bar 110.

The invention claimed is:

1. A workout device including a secured modular quick coupling system comprising:

a vice-like mechanism including:

a fixed jaw;

a movable jaw;

a threaded rod with a non-circular cross section, passing through said fixed jaw, one end of said threaded rod connected to said movable jaw, and said threaded rod engaged with said fixed jaw by a slider joint, which allows the threaded rod and the movable jaw to have a sliding movement only, in relation with the fixed jaw;

an adjustment nut comprising internal threads, wherein the internal threads are engaged with said threaded rod, wherein the adjustment nut is connected to said fixed jaw by a revolute joint, such that the adjustment nut is configured to adjust the sliding movement of said threaded rod and consequently said movable jaw in relation with said fixed jaw, in order to tighten or loosen said vice like mechanism; and a mechanical connection configured to connect at least one handle to said vice-like mechanism;

said workout device further configured to accept at least one module configured to be grabbed by said vice-like mechanism and further configured to accept additional modules sequentially, such that after the insertion of said at least one module, another module may be added, followed by further additional modules, with a maximum number of modules being limited by the space between said fixed jaw and said movable jaw;

wherein the non-circular cross section of said threaded rod is defined by two opposite cylindrical threaded sides and two opposite flat sides, wherein a width of the threaded rod measured between the two opposite flat sides is smaller than a width of the threaded rod measured between the two opposite cylindrical threaded sides;

wherein said slider joint is formed by said non-circular cross section of said threaded rod passing through and being received by an opening in said fixed jaw;

wherein an axis of said slider joint defines an axial direction of said vice-like mechanism and a radius of said threaded rod defines a radial direction of said vice-like mechanism;

wherein said at least one module is configured to:

a) radially slide between said fixed jaw and said movable jaw;

b) be axially gripped between said fixed jaw and said movable jaw;

c) include an axial cylindrical hole, a diameter of said axial cylindrical hole being not smaller than the width of the threaded rod measured between the two opposite cylindrical threaded sides of said threaded rod, allowing said at least one module to freely rotate about and axially slide along the threaded rod when said threaded rod is located completely inside said axial cylindrical hole;

d) include a slot, configured to:

extend from a perimeter of the at least one module to said axial cylindrical hole;

wherein the slot has a width not smaller than the width of the threaded rod measured between said two opposite flat sides, but smaller than the width of the threaded rod measured between the two opposite cylindrical threaded sides of the threaded rod, such that the threaded rod can only be slid into the slot when the two opposite flat sides are in line with the slot, but cannot be slid into the slot if otherwise aligned due to the width of the threaded rod measured between the two opposite cylindrical sides being bigger than the width of the slot;

wherein the slot guides the threaded rod to slide into said axial cylindrical hole, where the threaded rod can freely rotate;

e) have an inserted position when the at least one module is inserted between said fixed jaw and said movable jaw, wherein the threaded rod is completely inside said axial cylindrical hole;

f) have an engaged position where:

the at least one module is in said inserted position;

the two opposite flat sides of the threaded rod are not aligned with said slot and consequently the threaded rod cannot enter the slot, thus, the at least one module is radially locked and cannot radially move away from the threaded rod, while said at least one module can still axially slide along the threaded rod, and rotate about the threaded rod in order to become disengaged from the threaded rod;

g) include at least one axial guiding pin, which protrudes from at least one end of the at least one module; and h) include at least one receiving opening, wherein the at least one receiving opening is configured to receive at least one axial guiding pin of another module, wherein the another module is separate from the at least one module;

wherein said fixed jaw and said movable jaw each include at least one receiving opening which are separate from said at least one receiving opening of said at least one module, and are configured to receive said at least one axial guiding pin of said at least one module;

said at least one axial guiding pin and said at least one receiving opening of said at least one module are configured to interact with said at least one receiving opening of said fixed jaw and said at least one receiving opening of said movable jaw;

wherein, when said at least one module is positioned in the inserted position, said at least one module must first be axially rotated to misalign said two opposite flat sides of the threaded rod with said slot;

wherein said misalignment prevents the threaded rod from sliding inside the slot, thereby securing said engaged position;

wherein, once in the engaged position, said at least one axial guiding pin of the at least one module can be positioned inside the at least one receiving opening of the fixed jaw, the movable jaw, or another module; and wherein the another module is separate from the at least one module that is positioned in the engaged position;

said secured modular quick coupling system further characterized by:

radially locking said at least one module when said at least one module is positioned in said engaged position;

locking the rotation of said at least one module around the threaded rod by engaging said at least one axial guiding pin of said at least one module and said at least one receiving opening of said fixed jaw, or said at least one receiving opening of said movable jaw or said at least one receiving opening of another module, wherein the another module is separate from the at least one module, thus, preventing said at least one module from rotation and unwanted disengagement from said threaded rod;

axially locking said at least one module between said fixed jaw and said movable jaw, and consequently preventing said at least one guiding pin of said at least one module from sliding out of said at least one receiving opening of said fixed jaw, or said at least one receiving opening of said movable jaw or said at least one receiving opening of another module, wherein the another module is separate from the at least one module; and preventing said at least one module from vibrating and jiggling by tightening the vice-like mechanism by rotating said adjustment nut.

2. The workout device according to claim 1 wherein said at least one module is at least in part an object or device configured to include a weight, a vibrator, a sensor, a flashlight, a housing, a fillable housing, a speaker, a bluetooth speaker, a memory storing device, a battery, a processor, a display, or a decorative module.

3. The workout device according to claim 2 wherein said at least one module is a weight, and a body of said weight is made by laser cutting a sheet of raw material including a sheet of steel, a sheet of stainless steel, or a sheet of cast iron.

4. The workout device according to claim 1 wherein said slot of said at least one module is configured to receive said at least one axial guiding pin of another module, wherein the another module is separate from the at least one module.

5. The workout device according to claim 4 wherein on said at least one module, when viewed axially, the slot, the axial cylindrical hole and the at least one axial guiding pin of said at least one module are all aligned along one straight line.

6. The workout device according to claim 1 wherein said at least one handle is a modular handle made of multiple sections, each section of the multiple sections having a male threaded connection at one end and a female threaded connection at another end, each said section being characterized by having at least one elastic stopper in the form of one of a nylon collar replacing at least 0.5 pitch of a last thread of one of the female threaded connection or the male threaded connection, a last thread being counted as the last thread to be engaged when a section of the multiple sections is being fastened to another section of the multiple sections, or a nylon insert.

7. The workout device according to claim 1 wherein an outer shape of said at least one module is one of a circle, a rectangle, a hexagon, a pentagon, an octagon, or a polygon.

8. The workout device according to claim 1 wherein said at least one module includes wireless capability to connect to another device including a smartphone, a tablet, a laptop, or a pc.

9. The workout device according to claim 1 wherein said at least one handle is in the form of a standard gym workout handle including a curl handle, a Lat bar, a revolving lat bar, a cable bar, a single rope attachment, a stirrup handle, a multi exercise bar, a row handle, a V-bar, a D-handle, a D-handle straps, a head harness, a triceps extension rope, a kettlebell handle, an EZ-bar handle, an Indian Club handle, or a Persian meel handle.

10. The workout device according to claim 1 further including a connectable flexible guard to cover said secured modular quick coupling system in order to prevent damage if the workout device hits someone during a workout.

11. The workout device according to claim 1 further including a stand, said stand configured to be mechanically connected to at least one part of said workout device.

12. The workout device according to claim 1 wherein said at least one handle includes at least one of a spring snap hook, a resistance band, a loop band, a hook, a loop, a decorative add on, or a weight.

13. The workout device according to claim 1 wherein said revolute joint includes a solution to avoid loosening including at least one of an elastic threadlocker, a spring plunger, or a ratchet mechanism.

14. The workout device according to claim 1, wherein a position of said at least one axial guiding pin of said at least one module is configured such that said at least one module needs to rotate at least 10 degrees after being positioned in the inserted position in order to place said at least one axial guiding pin inside said at least one receiving opening of one of said fixed jaw, said movable jaw, or another module, wherein said another module is separate from the at least one module.

* * * * *